US011467541B2

(12) United States Patent
Guo

(10) Patent No.: US 11,467,541 B2
(45) Date of Patent: Oct. 11, 2022

(54) WATCH WITH DOUBLE WATCH-SURFACE AND METHOD FOR DISASSEMBLING SAME

(71) Applicant: Jun-Liang Guo, Tainan (TW)

(72) Inventor: Jun-Liang Guo, Tainan (TW)

( * ) Notice: Subject to any disclaimer, the term of this patent is extended or adjusted under 35 U.S.C. 154(b) by 338 days.

(21) Appl. No.: 16/815,039

(22) Filed: Mar. 11, 2020

(65) Prior Publication Data

US 2020/0209808 A1 Jul. 2, 2020

(51) Int. Cl.
*G04B 37/22* (2006.01)
*G04D 3/00* (2006.01)

(52) U.S. Cl.
CPC ..... *G04B 37/22* (2013.01); *G04D 3/0002* (2013.01)

(58) Field of Classification Search
CPC .... G04B 45/0076; G04B 37/22; G04B 37/00; G04B 37/0008; G04B 37/0033; G04B 37/0041; G04B 37/0083; G04D 3/0002; A44C 15/0025
See application file for complete search history.

(56) References Cited

U.S. PATENT DOCUMENTS 5,479,381 A * 12/1995 Goldenberg ..... G04B 45/0084 224/175
6,779,917 B1 * 8/2004 Chappuis ..... A44C 5/147 368/282
7,507,017 B2 * 3/2009 Chevalier ..... A44C 5/14 368/282
9,639,058 B1 * 5/2017 Mohanty ..... G04B 37/12
2006/0018202 A1 * 1/2006 Girardin ..... G04G 17/08 368/281

* cited by examiner

*Primary Examiner* — Edwin A. Leon

(57) ABSTRACT

A method for disassembling first and second watch-surfaces of a watch includes the steps of removing a decorative cover from the watch; rotating an adjusting screw to move an H-shaped snapping member toward a casing so that the H-shaped snapping member abuts against the adjusting screw; rotating a snapping ring so that an engaging protrusion does not overlap a pressing protrusion and the snapping ring can be removed from the casing; opening the watch; using a tool to press against a platform of the connecting sleeve; rotating the main screw to remove the connecting sleeve; removing the first watch-surface from the casing; removing first and second positioning rings and suspension columns; turning the casing to remove the snapping ring; opening the watch; using the tool to press against the platform; rotating the main screw to remove the connecting sleeve; and removing the second watch-surface from the casing.

1 Claim, 31 Drawing Sheets

WATCH WITH DOUBLE WATCH-SURFACE AND METHOD FOR DISASSEMBLING SAME

CROSS-REFERENCE TO RELATED APPLICATION

This application is a divisional application of U.S. patent application Ser. No. 15/872,056, entitled "watch with double watch-surface and method for disassembling same" filed Jan. 16, 2018, the entire content of which is incorporated herein by reference.

BACKGROUND OF THE INVENTION

1. Field of the Invention

The invention relates to watches and more particularly to a watch having a double watch-surface and a method for disassembling the double watch-surface.

2. Description of Related Art

The conventional watch is most commonly composed of a casing, a watch-surface, a movement structure, a transparent cover, a back cover, a lug and a watch band configured to the lug. Watch can often be used to stand for a person's taste. Through the style of the watch, you can be aware of a lot of information such as a wearer's personality and preference and so on. For a more exquisite user, he may wear different watches on different occasions.

However, each watch is a unique design. If a user wants to show a different style, he/she needs to wear a different watch. Therefore, users may need to spend more money to buy different styles of watches. Furthermore, if watch is inadvertently damaged or needs maintenance, it needs to be repaired by disassembling the back cover. Different models have different ways of disassembly, which not only needs to use a lot of hand tools, but also fails to directly view the repair area because the watchband may block the vision of the repair specialist.

Moreover, if a user often travels to two different time zones, the watch-surface also often needs to be adjusted to local time. Although the movement is simple, it makes one feel a little disturbing. The above problems are the shortcomings that the creators have personally experienced. The creators have paid attention to the above problems for many years. Therefore, after constantly researches, a watch having a double watch-surface watch overcoming the above shortcomings is created.

SUMMARY OF THE INVENTION

It is therefore one object of the invention to provide a method for disassembling first and second watch-surfaces of a watch, comprising the steps of rotating a decorative cover to remove the decorative cover from the watch; rotating an adjusting screw to move an H-shaped snapping member toward a center of a casing so that the H-shaped snapping member abuts against the adjusting screw; rotating a snapping ring so that an engaging protrusion does not overlap a pressing protrusion and the snapping ring is configured to remove; moving a main screw toward an outside of the watch to open the watch so that it is configured to see a connecting sleeve through a gap between the first watch-surface and the casing; using a tool to press against a platform of the connecting sleeve; rotating the main screw to remove the connecting sleeve; removing the first watch-surface from the casing; removing a first positioning ring, a plurality of suspension columns, and a second positioning ring; turning the casing horizontally to dismantle the snapping ring; moving the main screw toward the outside of the watch to open the watch so that it is configured to see the connecting sleeve through a gap between the second watch-surface and the casing; using the tool to press against the platform of the connecting sleeve; rotating the main screw to remove the connecting sleeve; and removing the second watch-surface from the casing.

The above and other objects, features and advantages of the invention will become apparent from the following detailed description taken with the accompanying drawings.

DETAILED DESCRIPTION OF THE INVENTION

Figure 1:
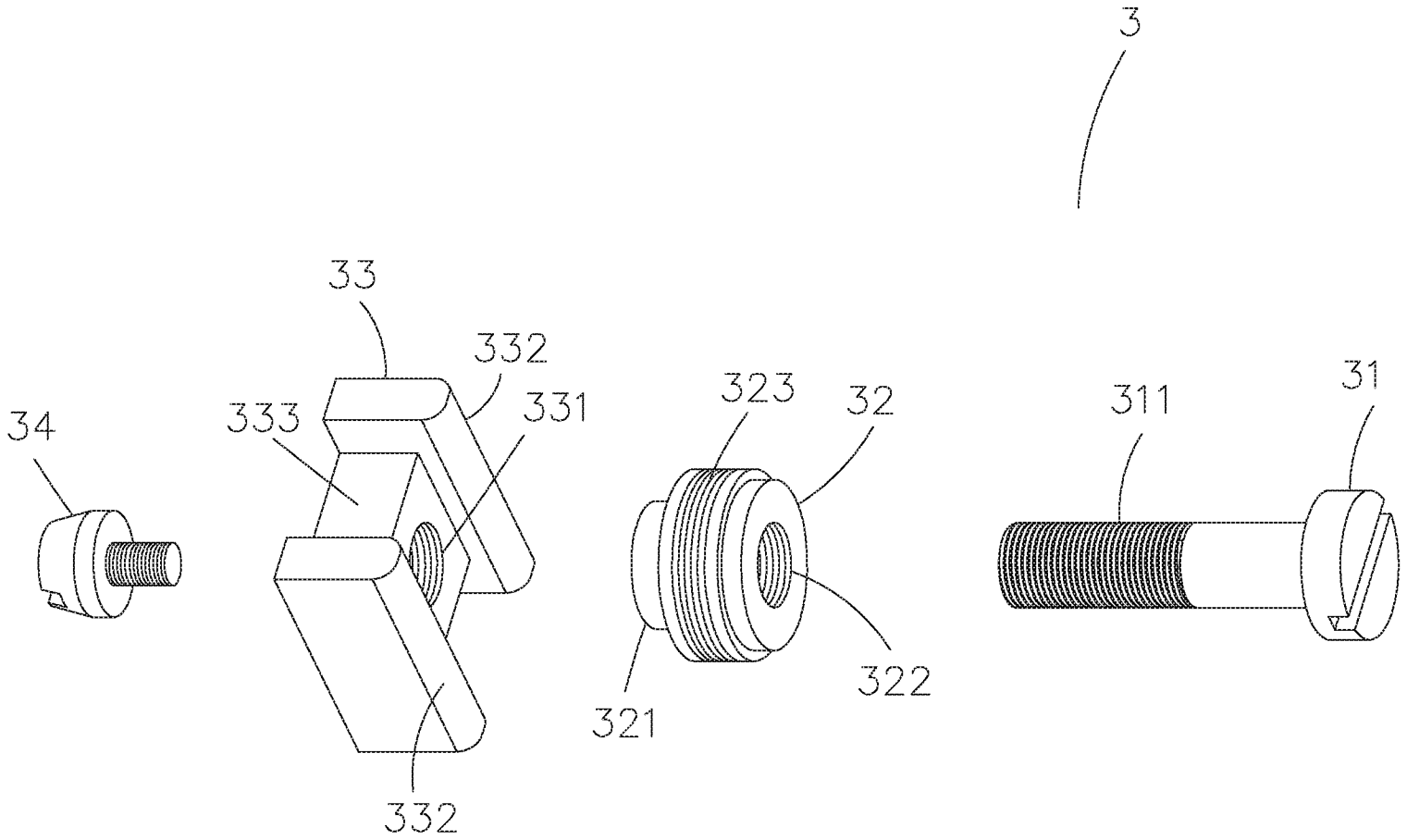
FIG. 1 is a perspective exploded view of the adjusting and snapping assembly of the invention.
Figure 2:
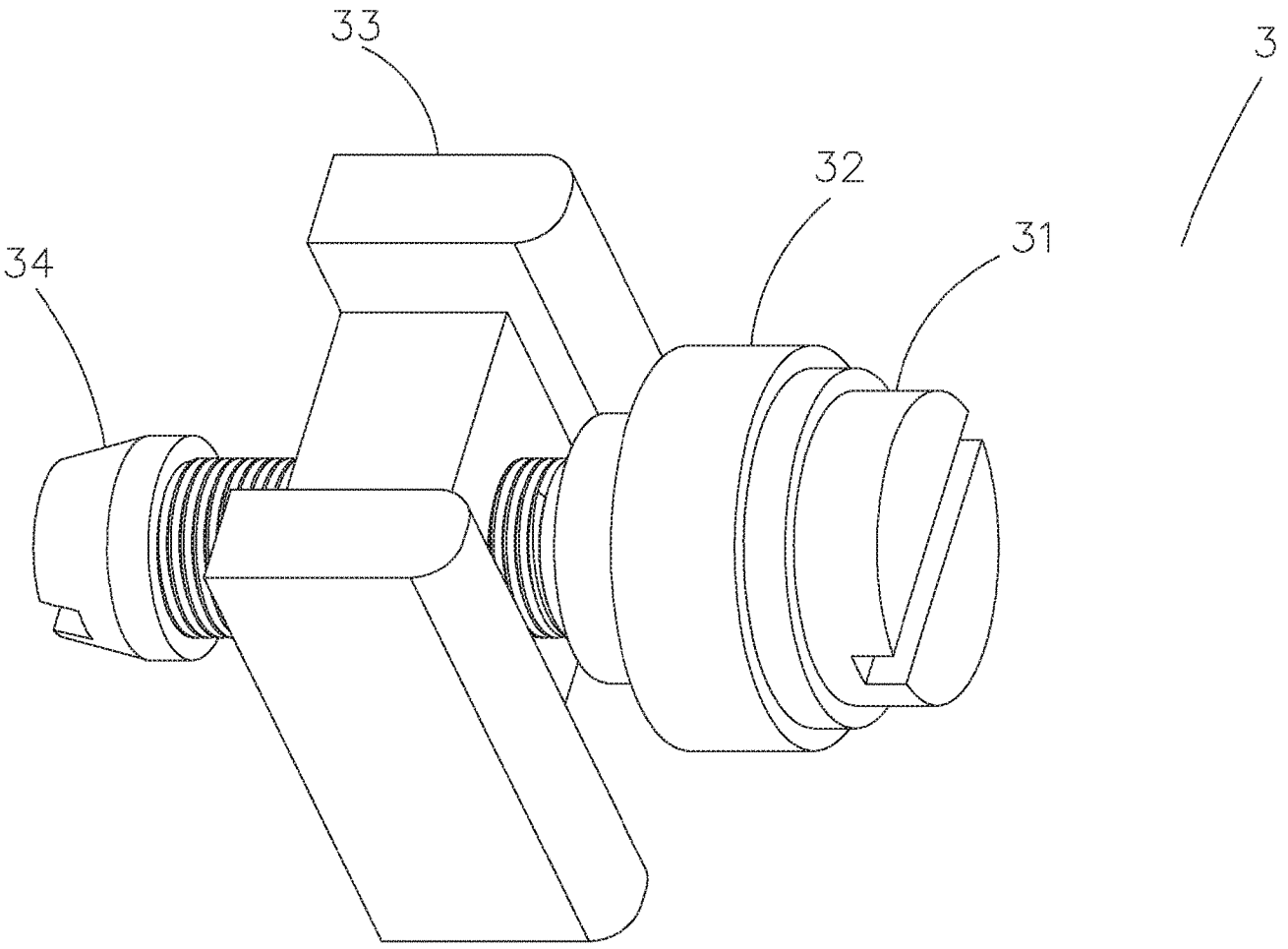
FIG. 2 is a perspective assembly view of the adjusting and snapping assembly.
Figure 3:
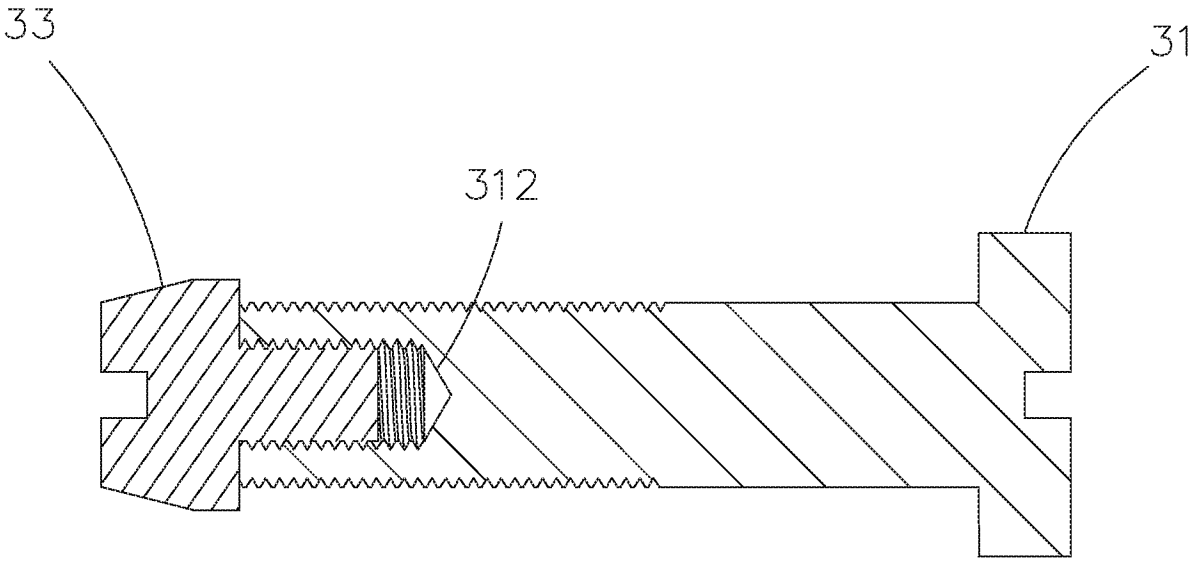
FIG. 3 is a cross-sectional view of the adjusting screw and the abutting screw assembly.
Figure 4:
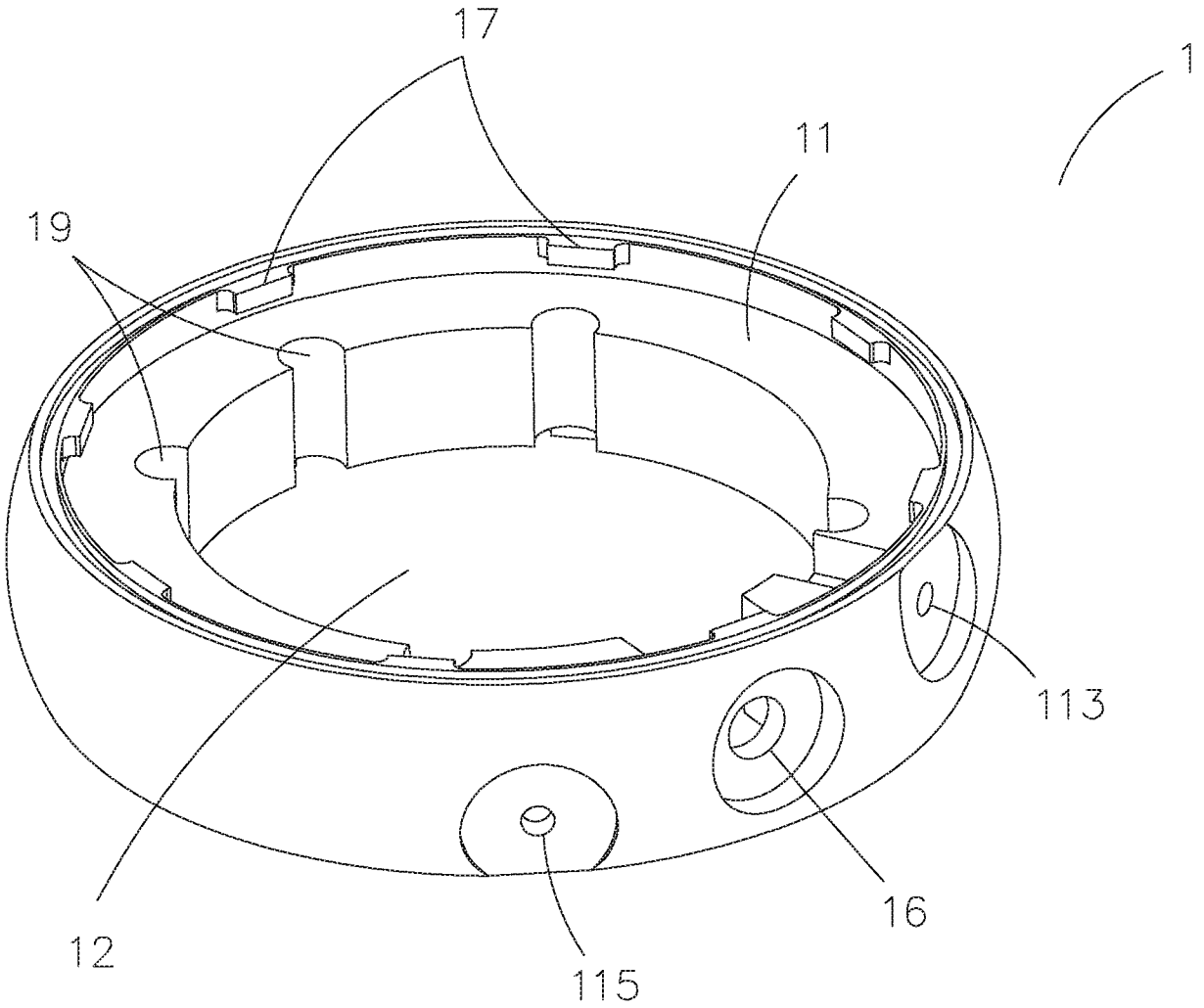
FIG. 4 is a perspective view of the casing.
Figure 5:
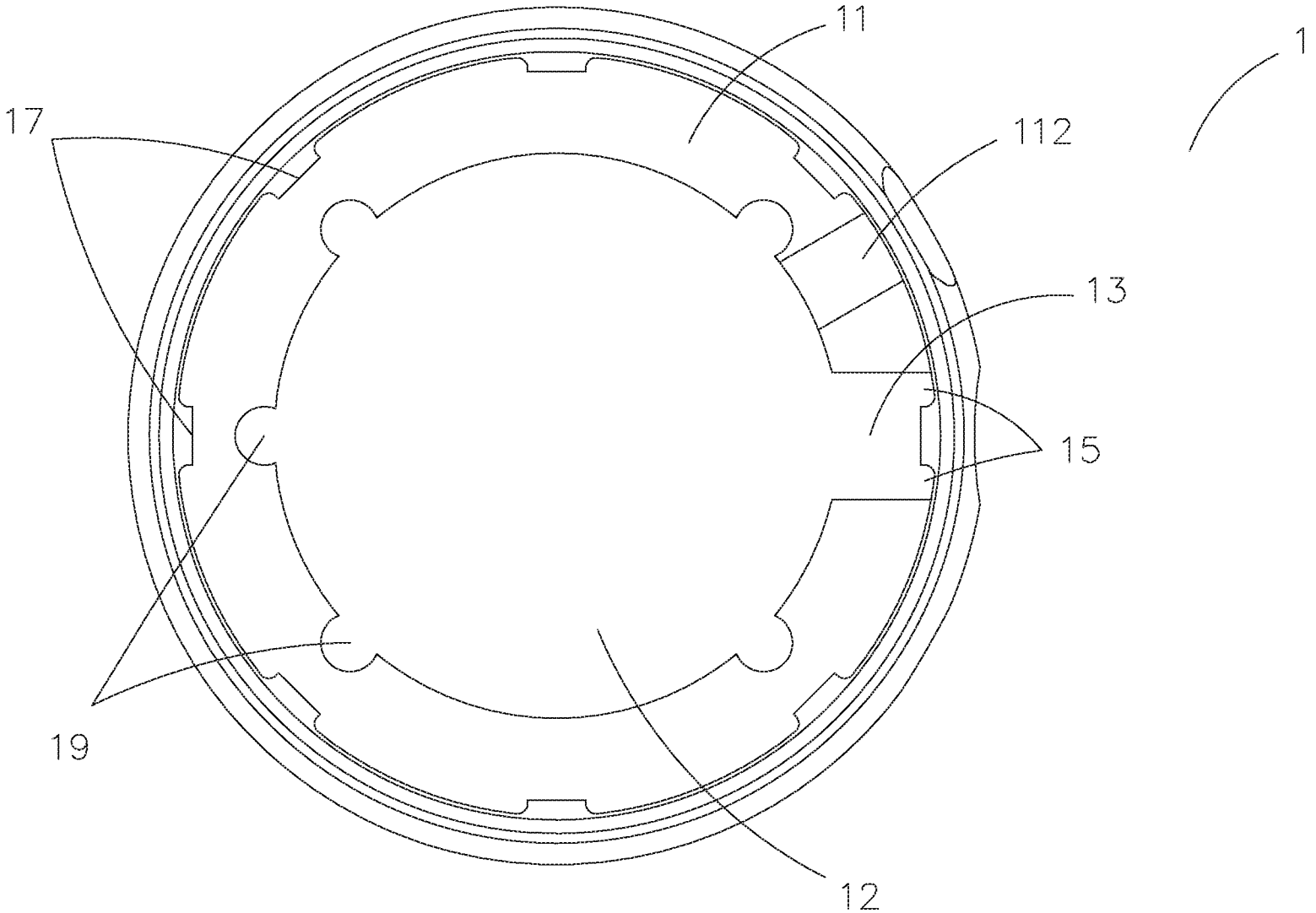
FIG. 5 is a top view of the casing.
Figure 6:
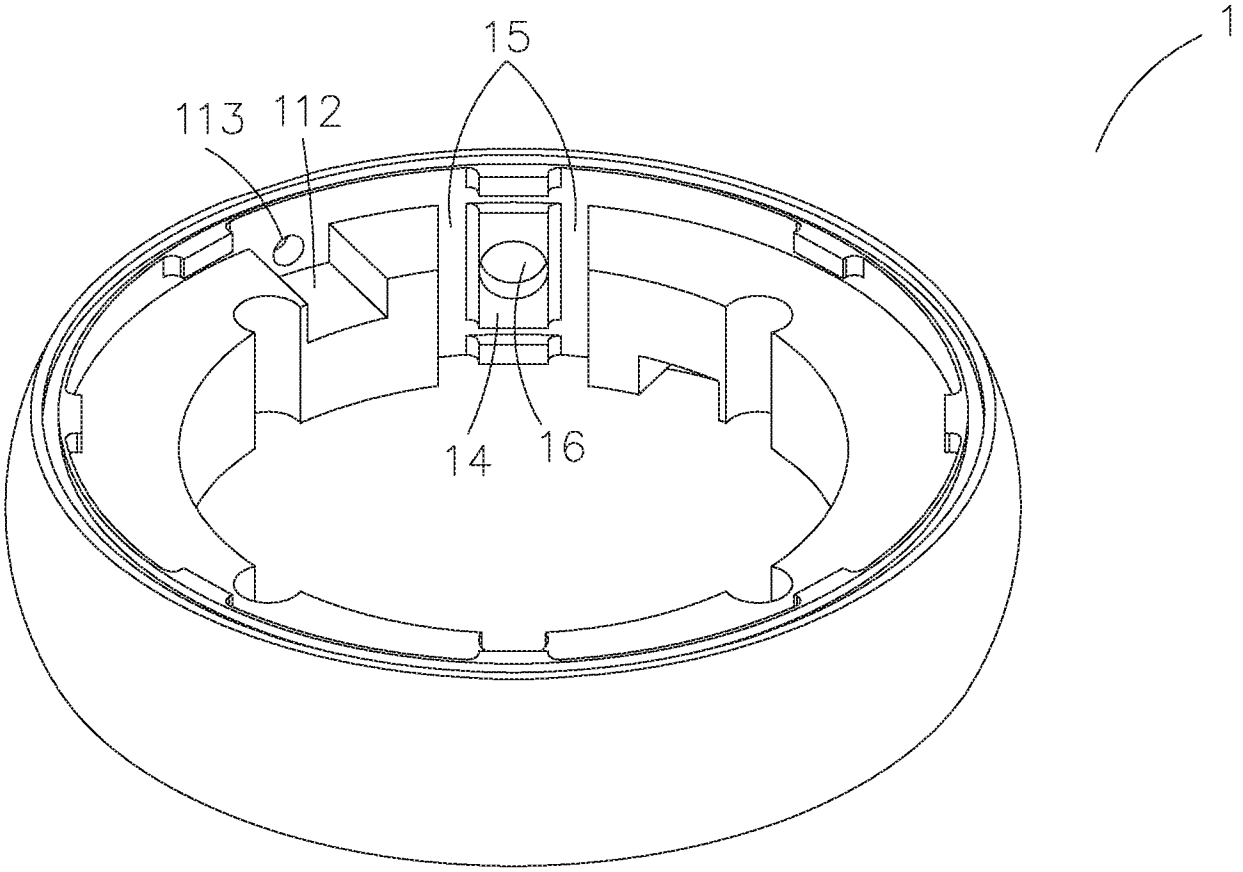
FIG. 6 is a perspective view of the casing from another angle.
Figure 7:
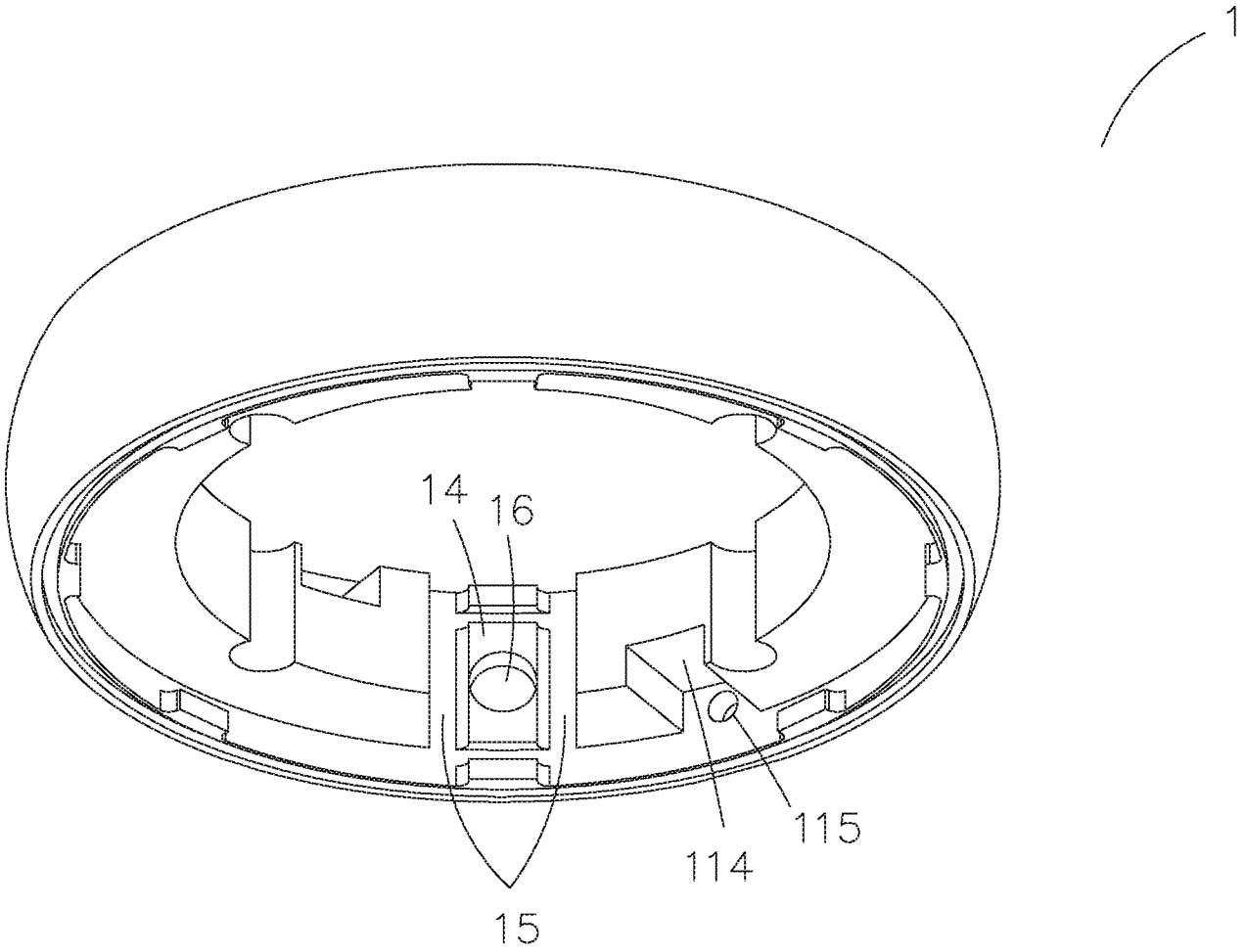
FIG. 7 is a perspective view of the casing from another angle.
Figure 8:
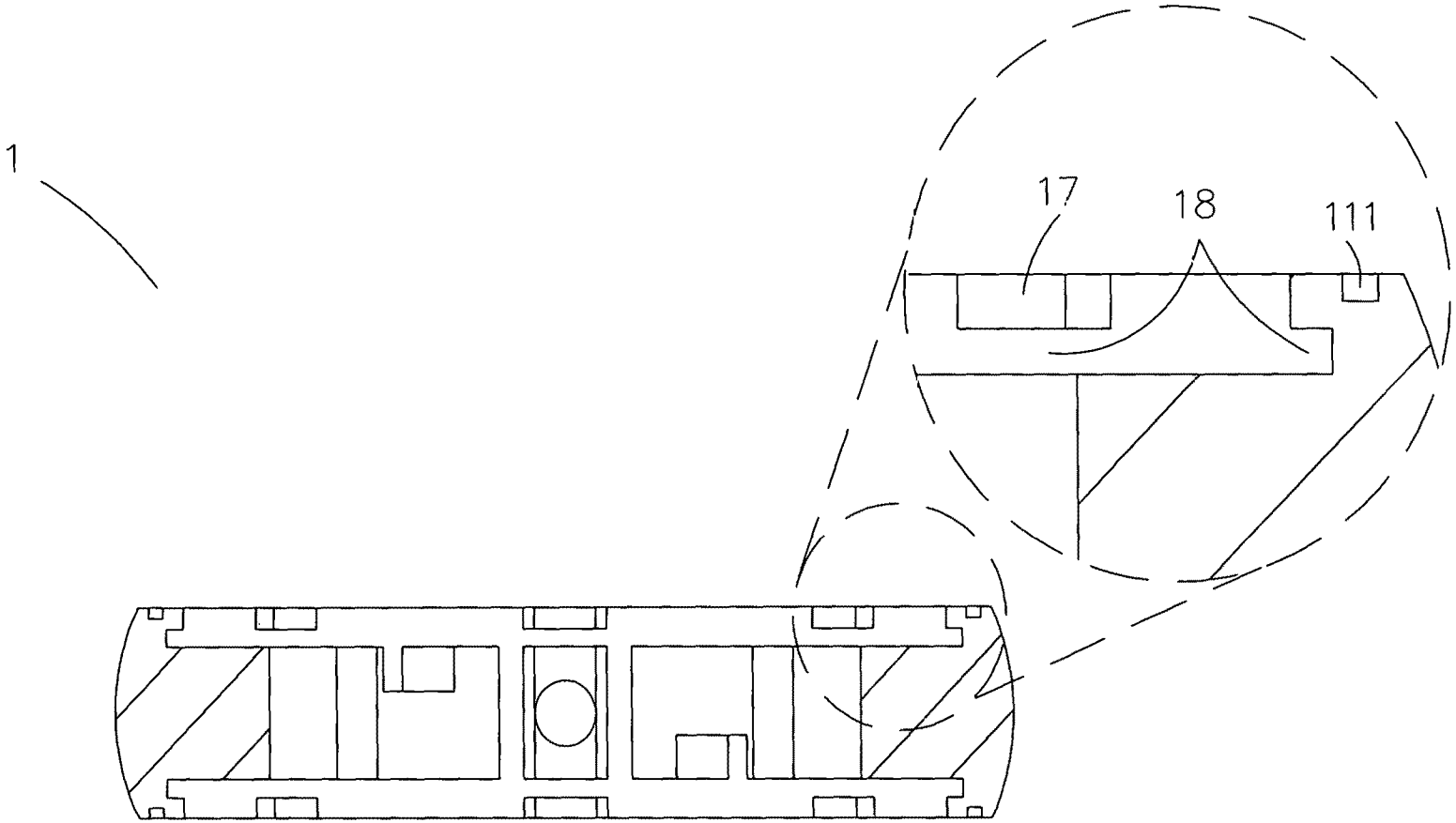
FIG. 8 is a cross-sectional view of the casing.
Figure 9:
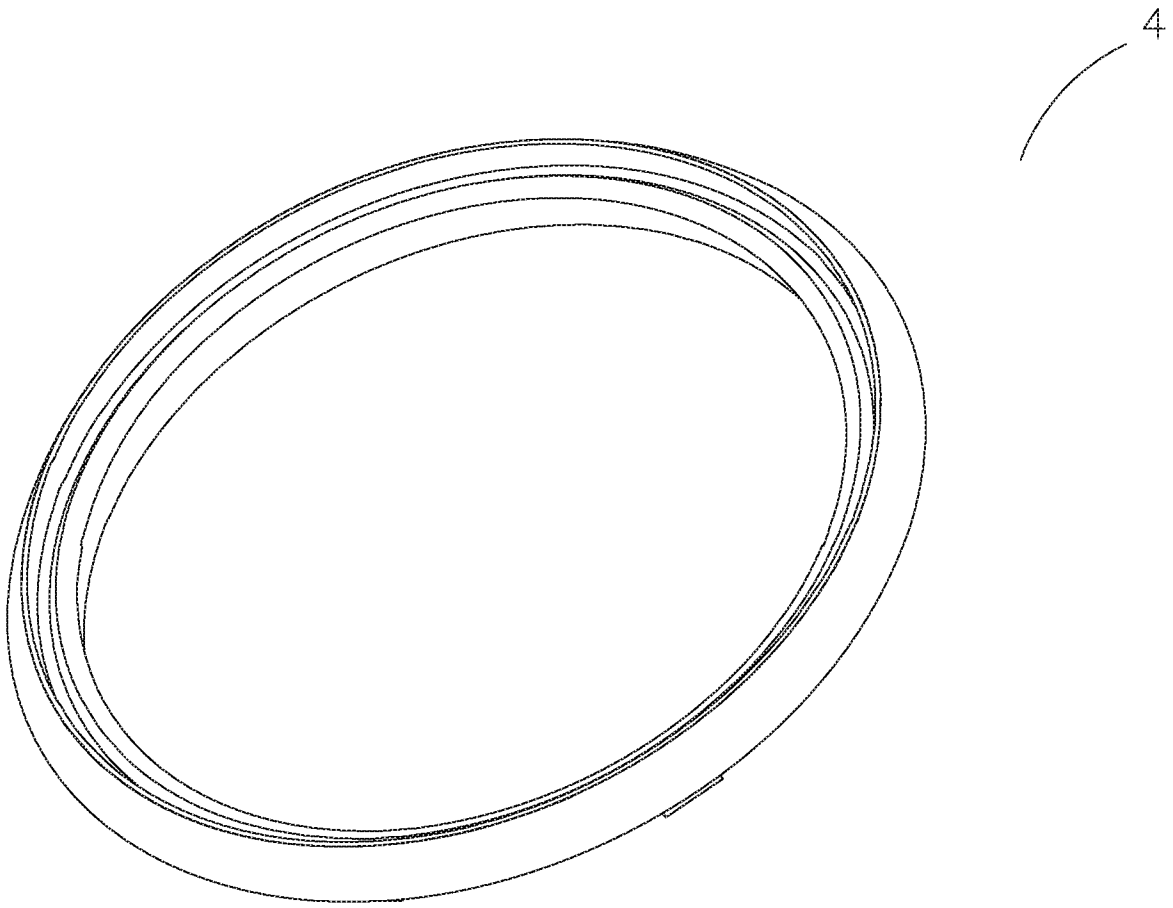
FIG. 9 is a perspective view of the snapping ring.
Figure 10:
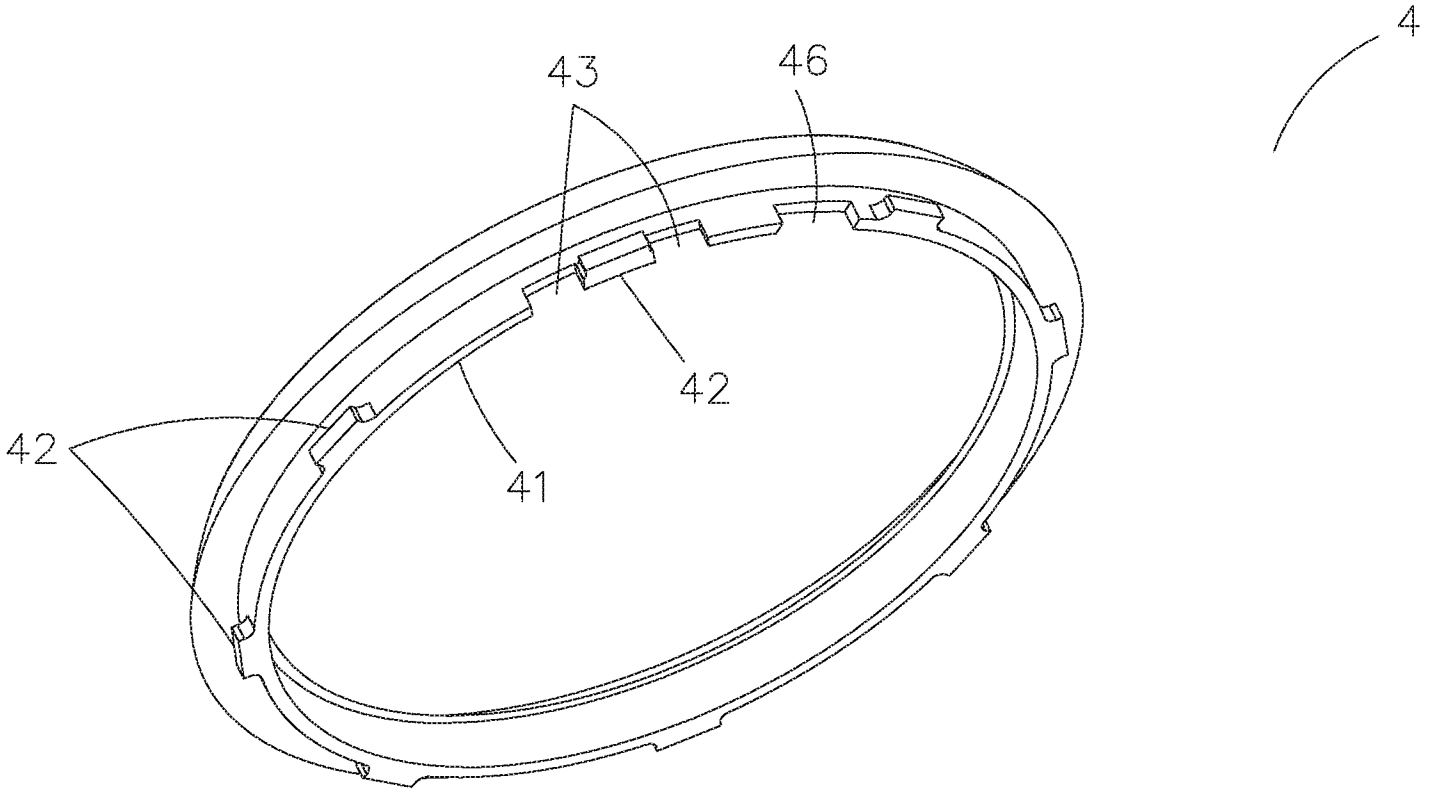
FIG. 10 is a perspective view of the snapping ring from another angle.
Figure 11:
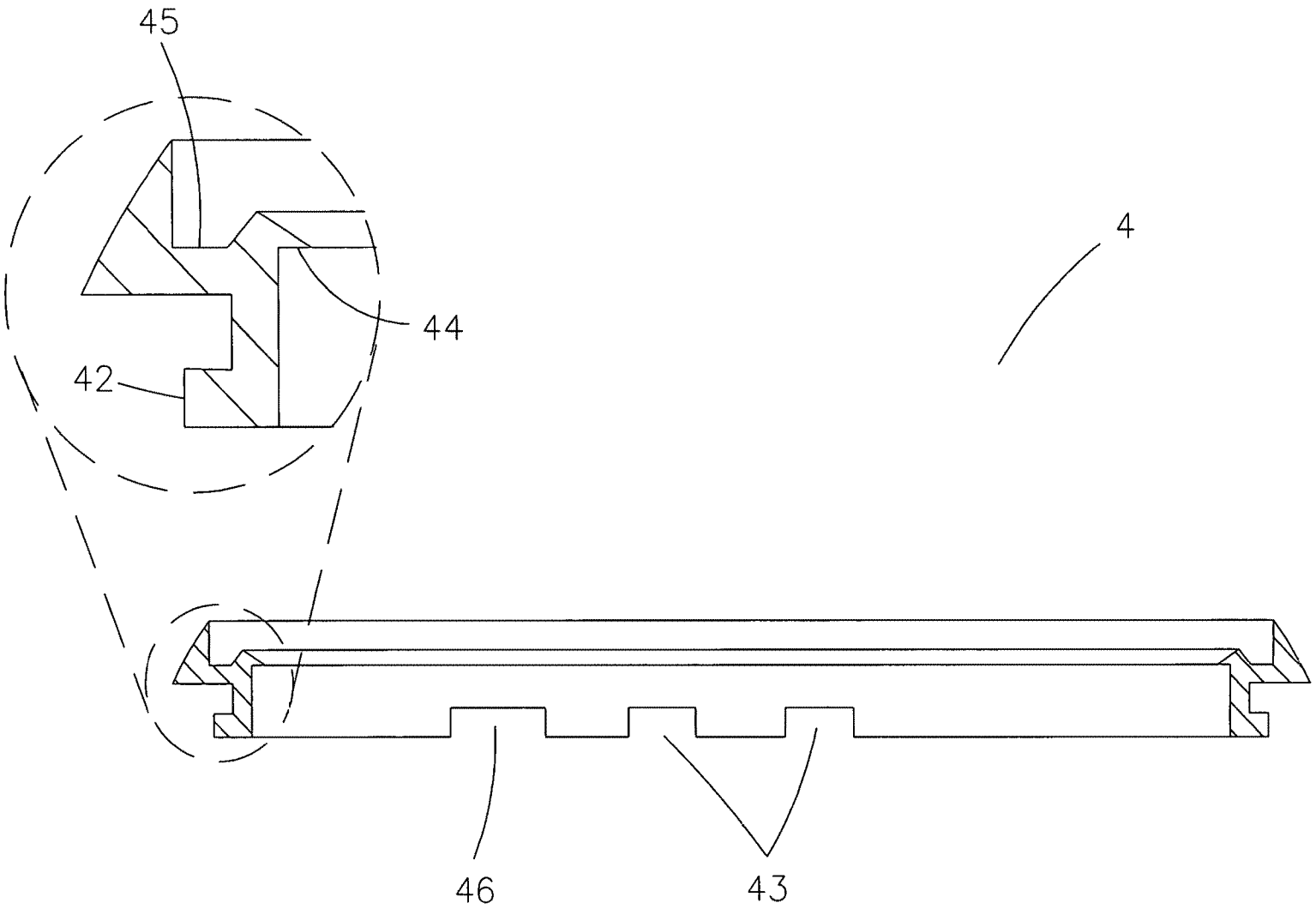
FIG. 11 is a cross-sectional view of the snapping ring.
Figure 12:
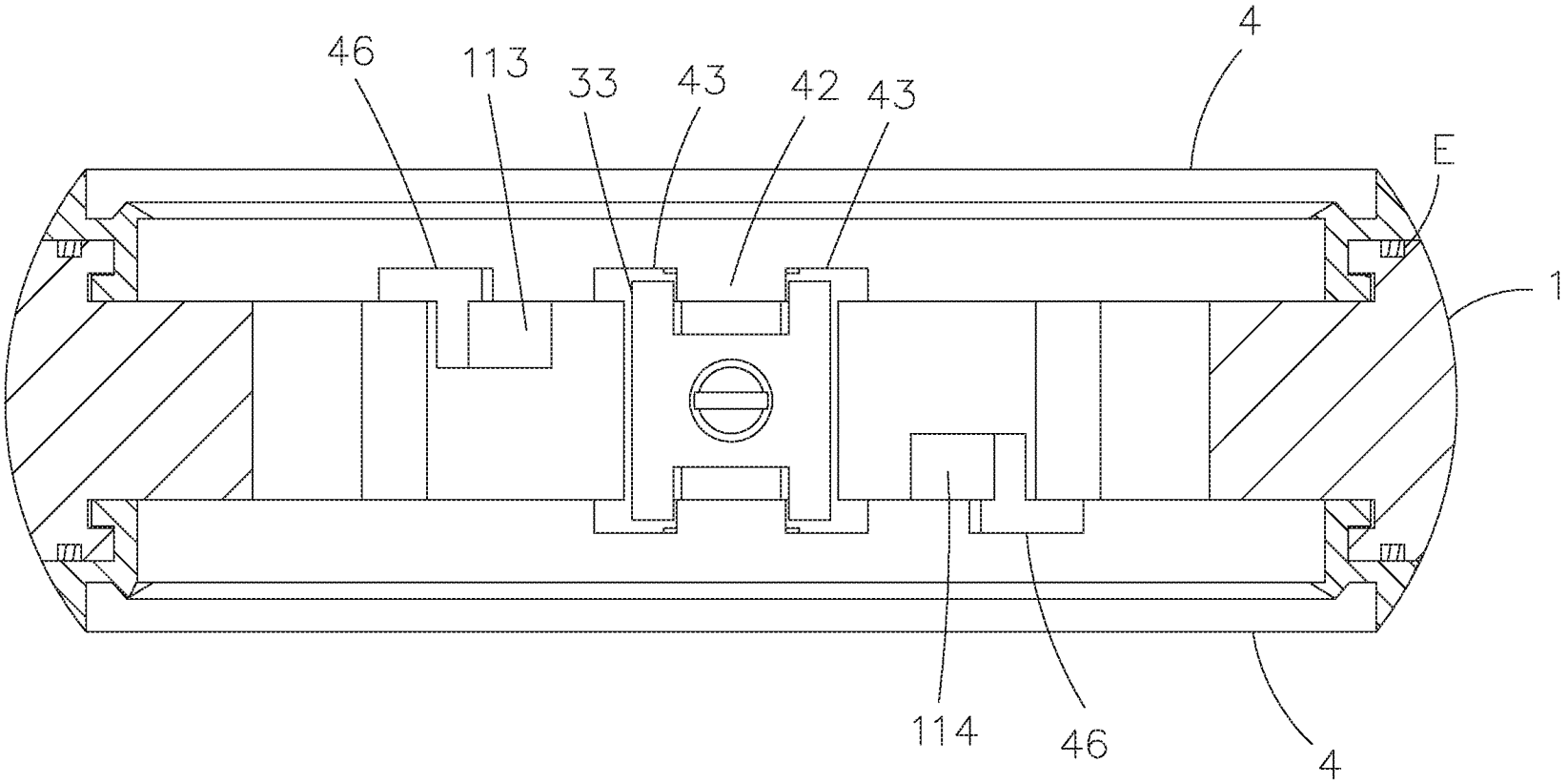
FIG. 12 is a cross-sectional view of the embodiment of the casing and the snapping ring assembly (1)
Figure 13:
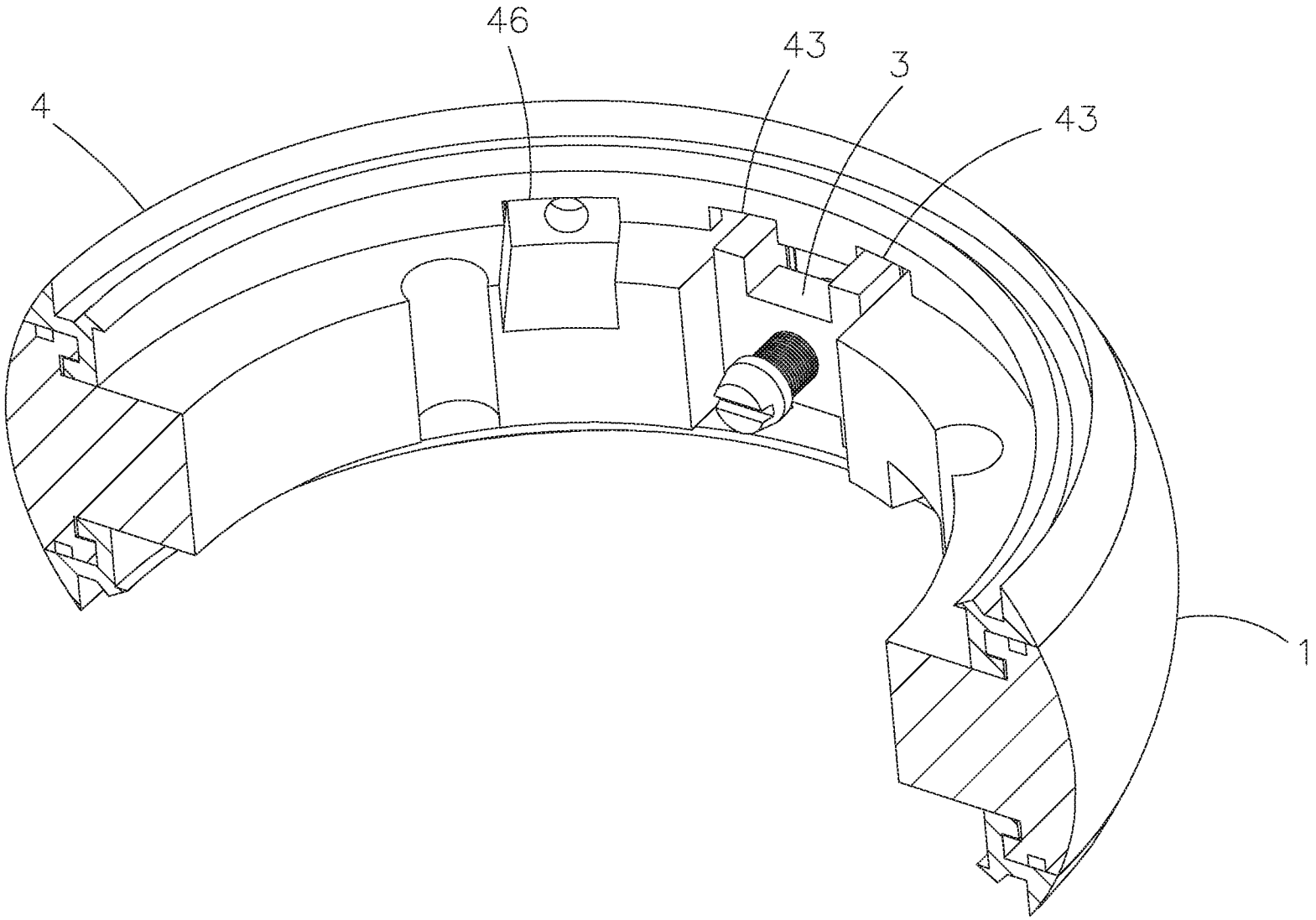
FIG. 13 is a cross-sectional view of the embodiment of the casing and the snapping ring combination (2)
Figure 14:
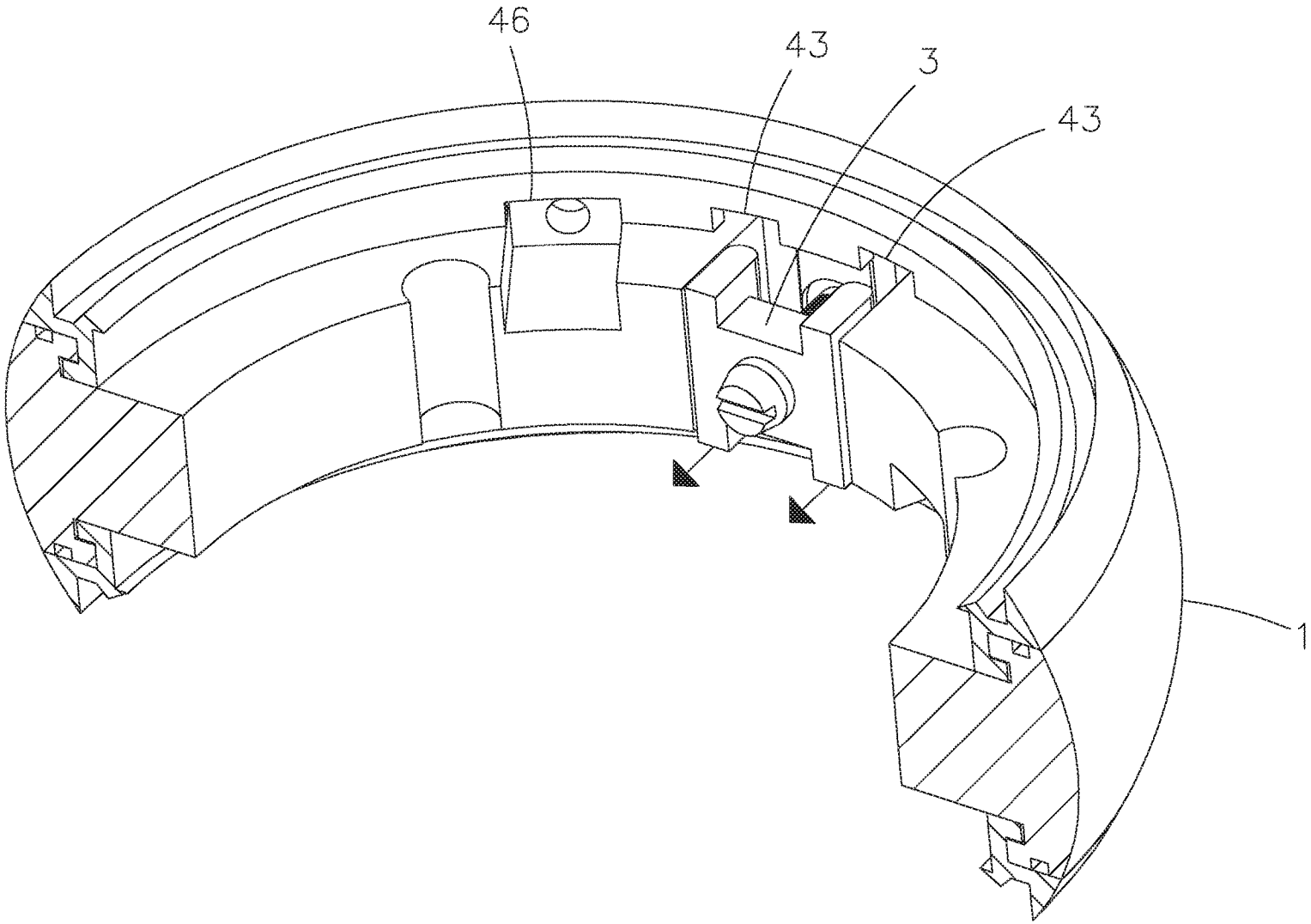
FIG. 14 is a cross-sectional view of the embodiment of the casing and the snapping ring assembly (3)
Figure 15:
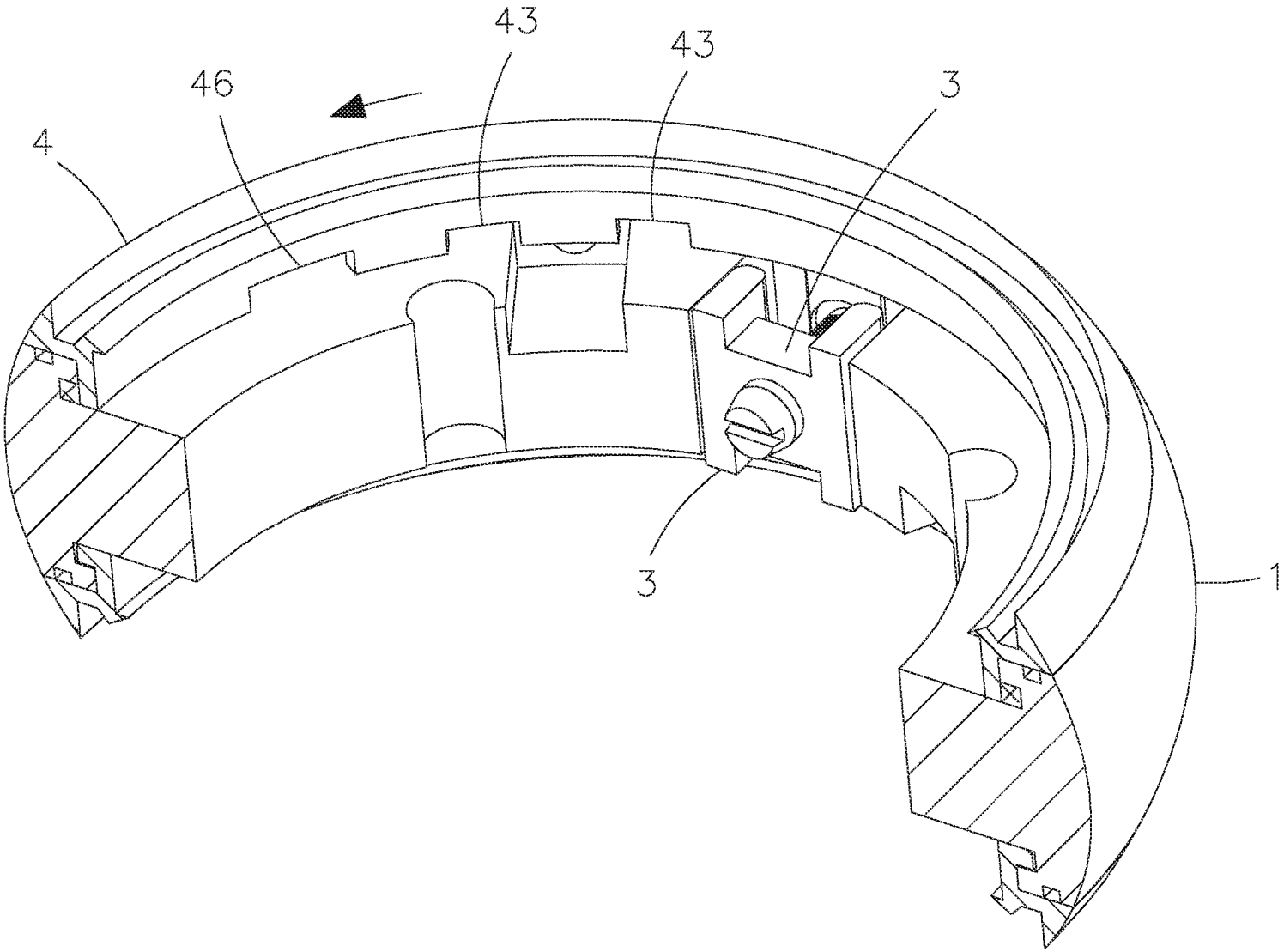
FIG. 15 is a cross-sectional view of the embodiment of the casing and the snapping ring assembly (4)
Figure 16:
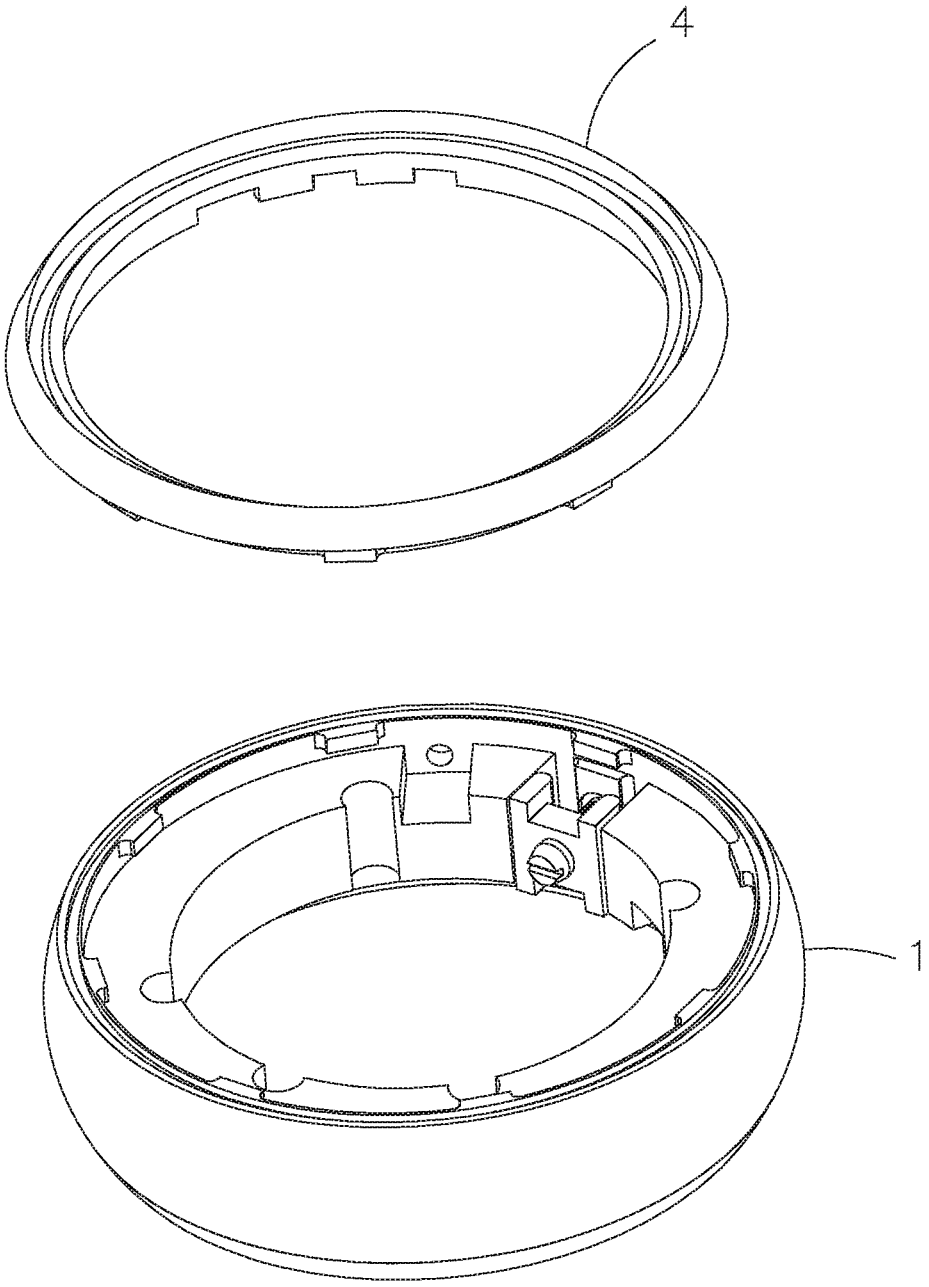
FIG. 16 is an exploded view of the embodiment of the casing and the snapping ring.
Figure 18:
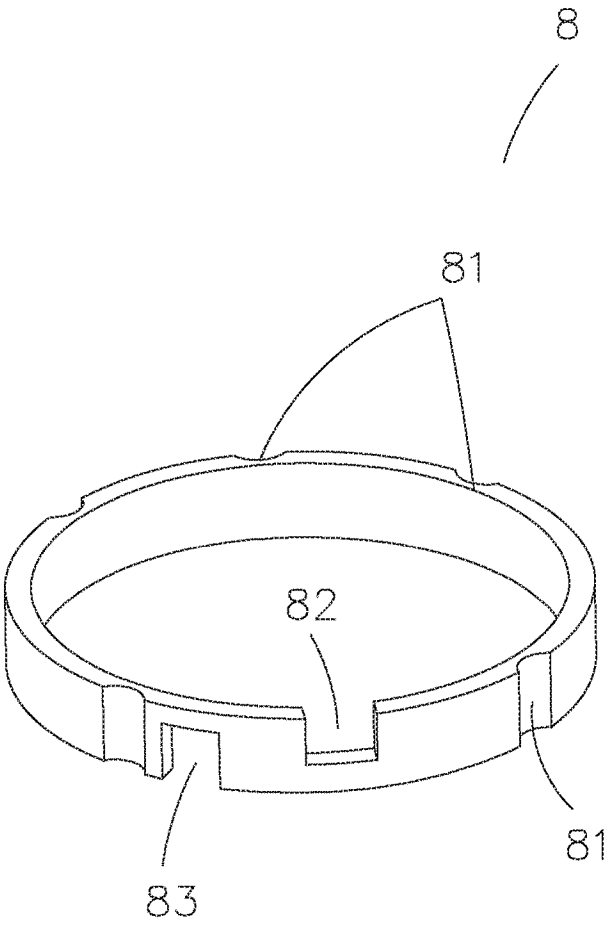
FIG. 18 is a perspective view of the second positioning ring.
Figure 17:
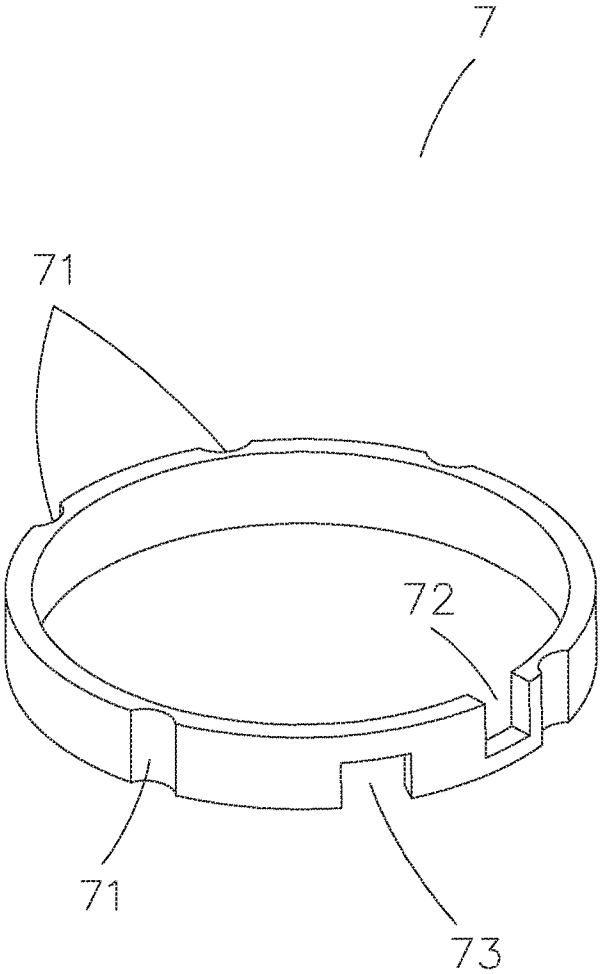
FIG. 17 is a perspective view of the first positioning ring.
Figure 19:
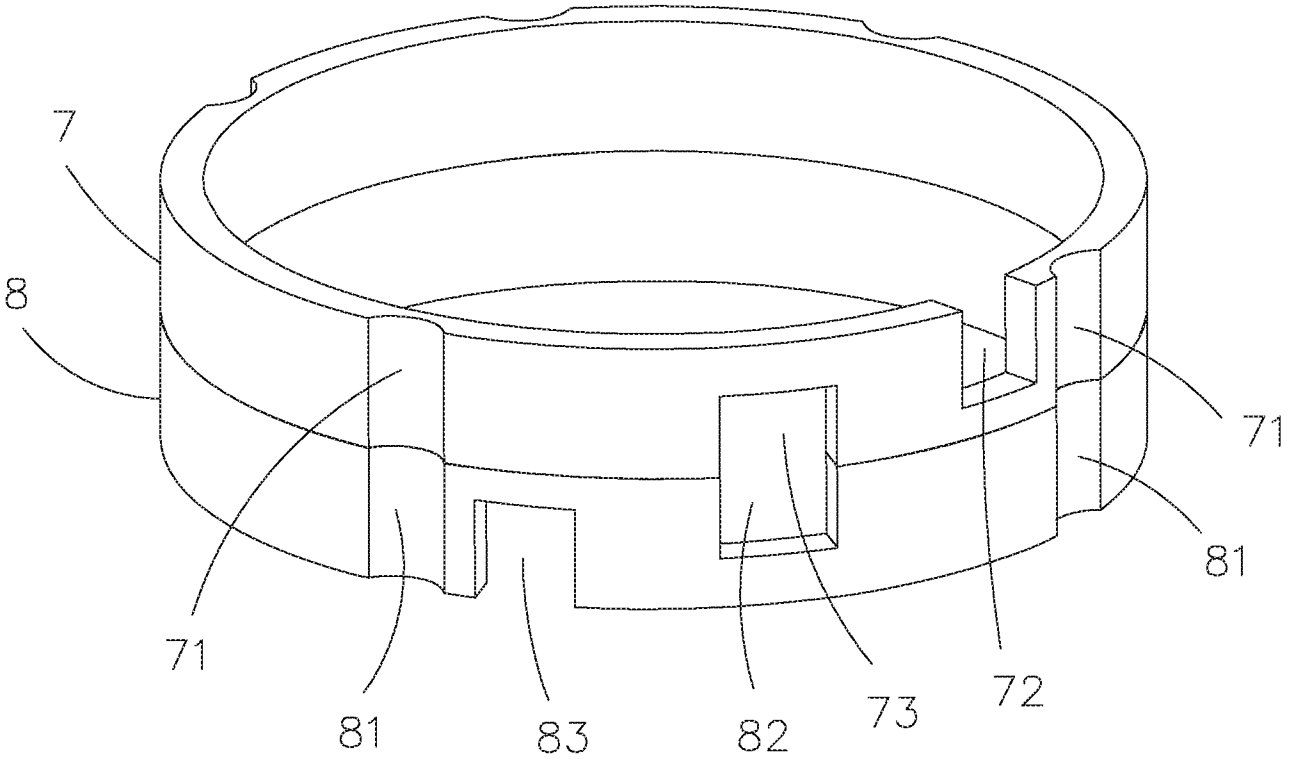
FIG. 19 is a perspective view of the embodiment of the first positioning ring and the second positioning ring assembly.
Figure 20:
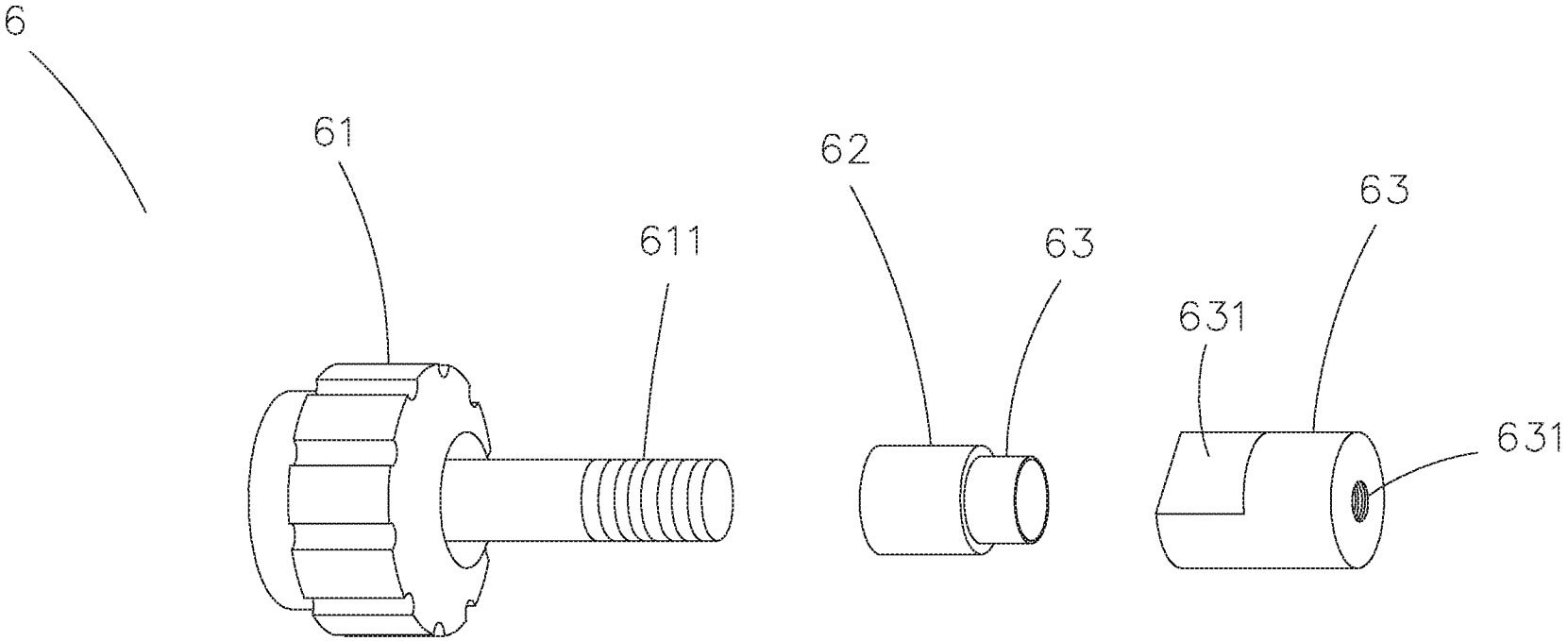
FIG. 20 is a perspective exploded view of the main adjusting assembly.
Figure 21:
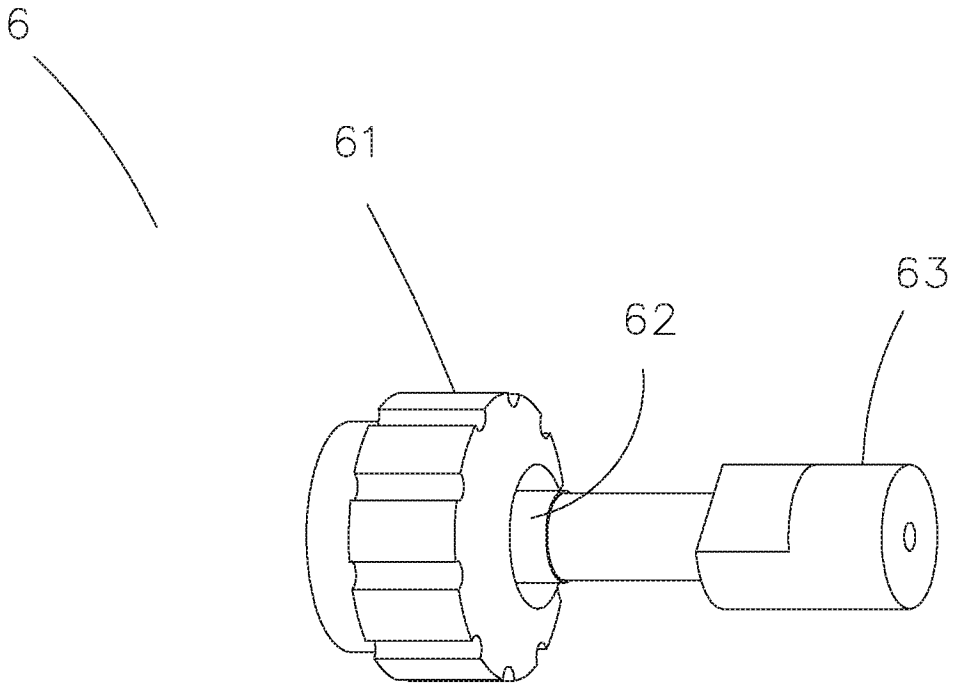
FIG. 21 is a perspective assembly view of the main adjusting assembly.
Figure 22:
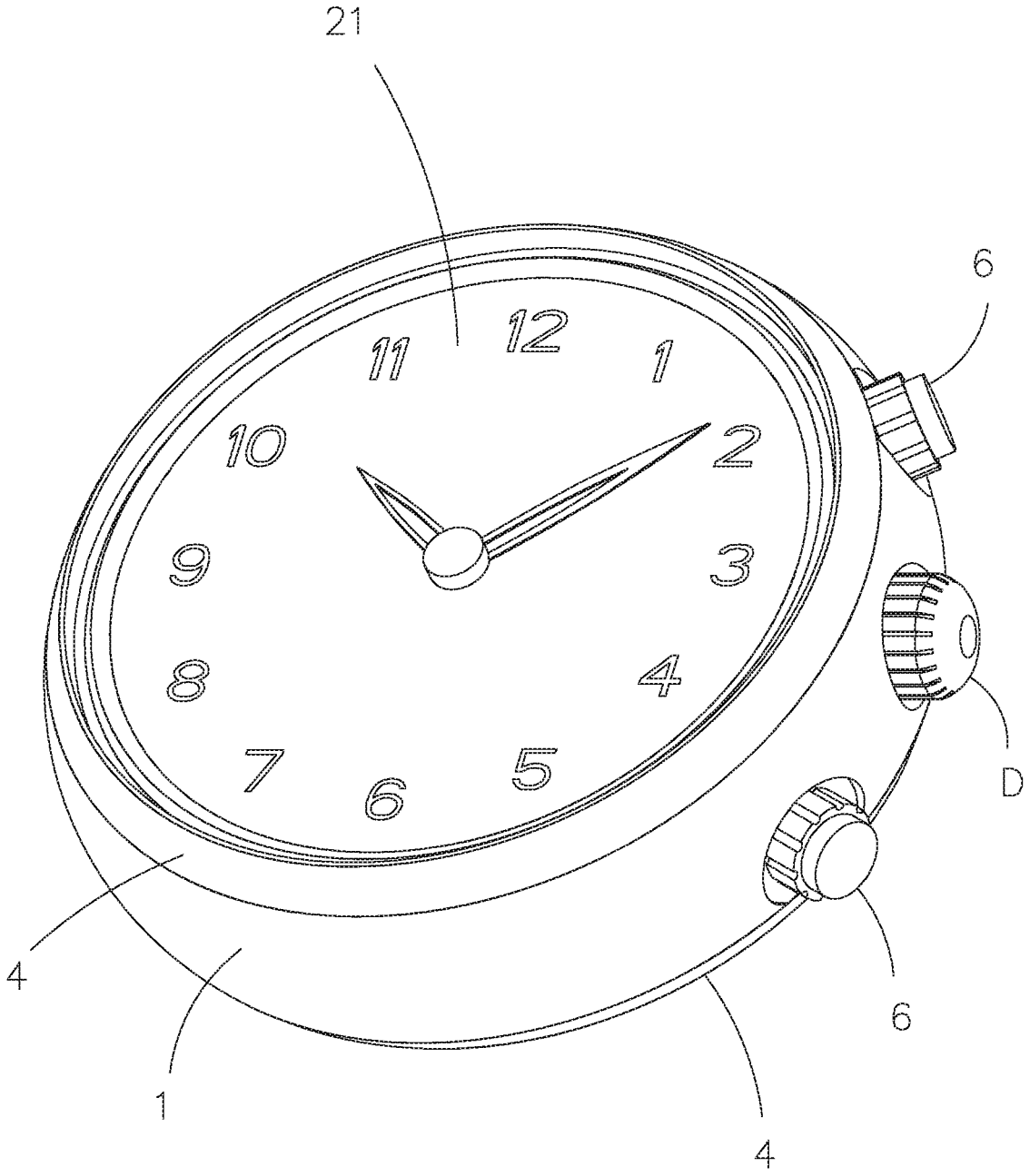
FIG. 22 is a perspective view of the embodiment of this creation (1)
Figure 23:
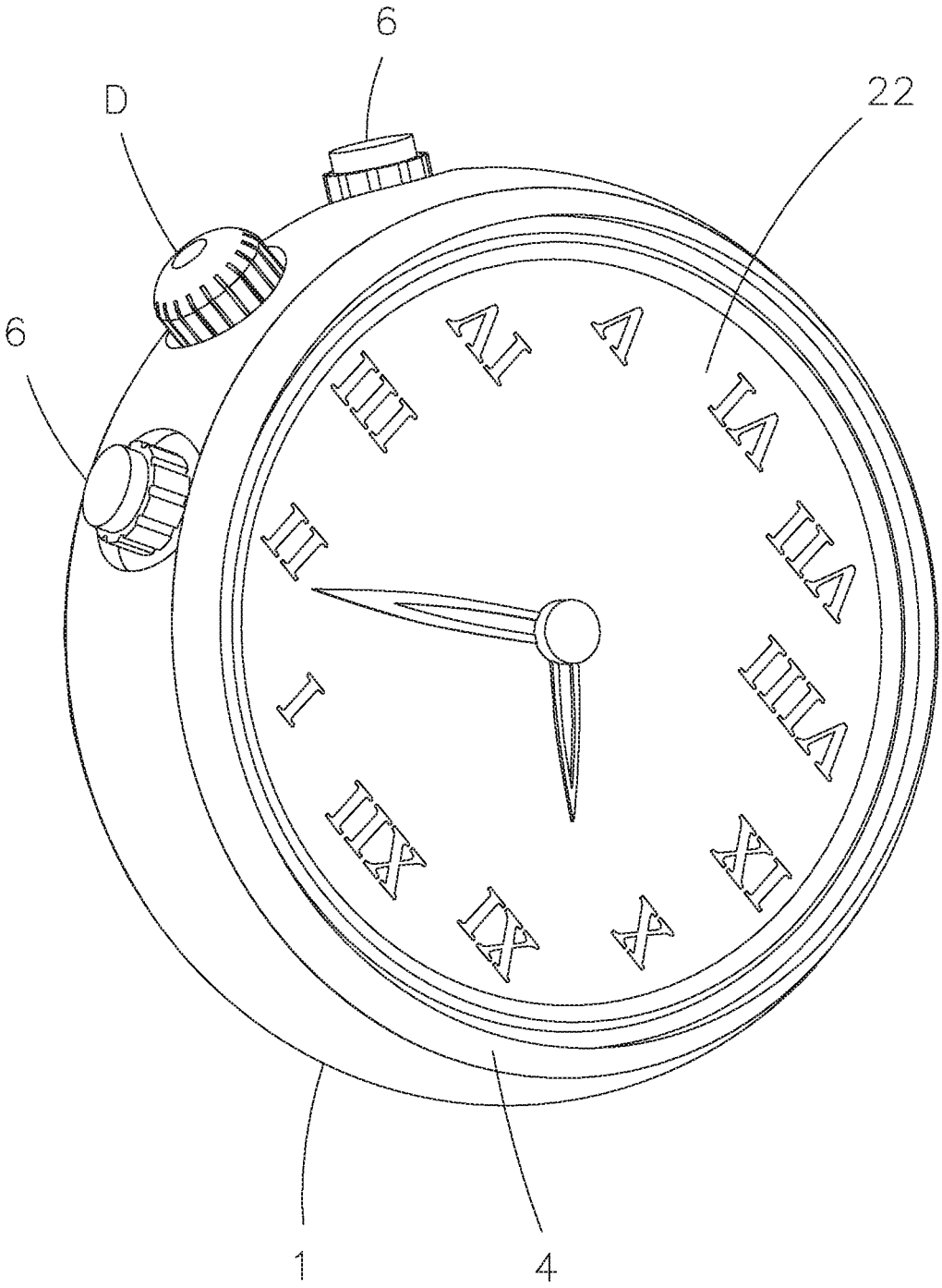
FIG. 23 is a perspective view of the embodiment of this creation (2)
Figure 24:
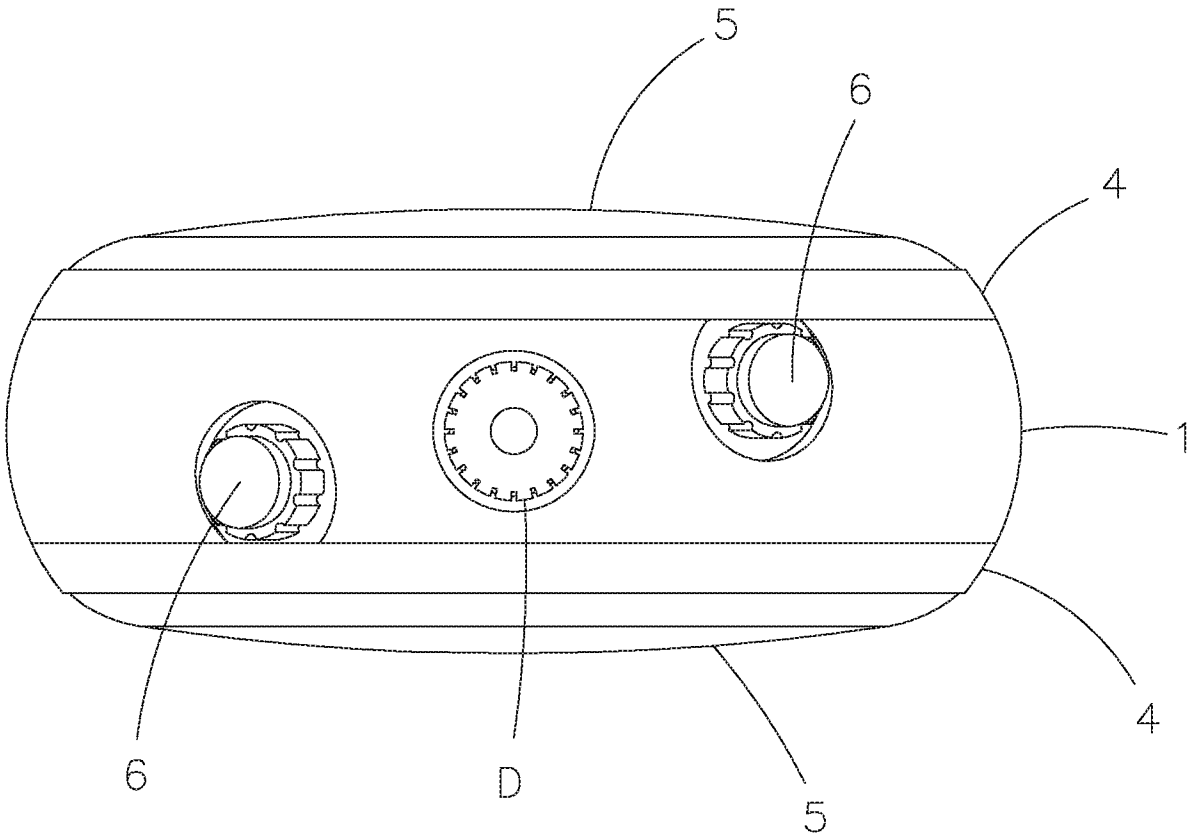
FIG. 24 is a perspective view of the embodiment of this creation (3)
Figure 25:
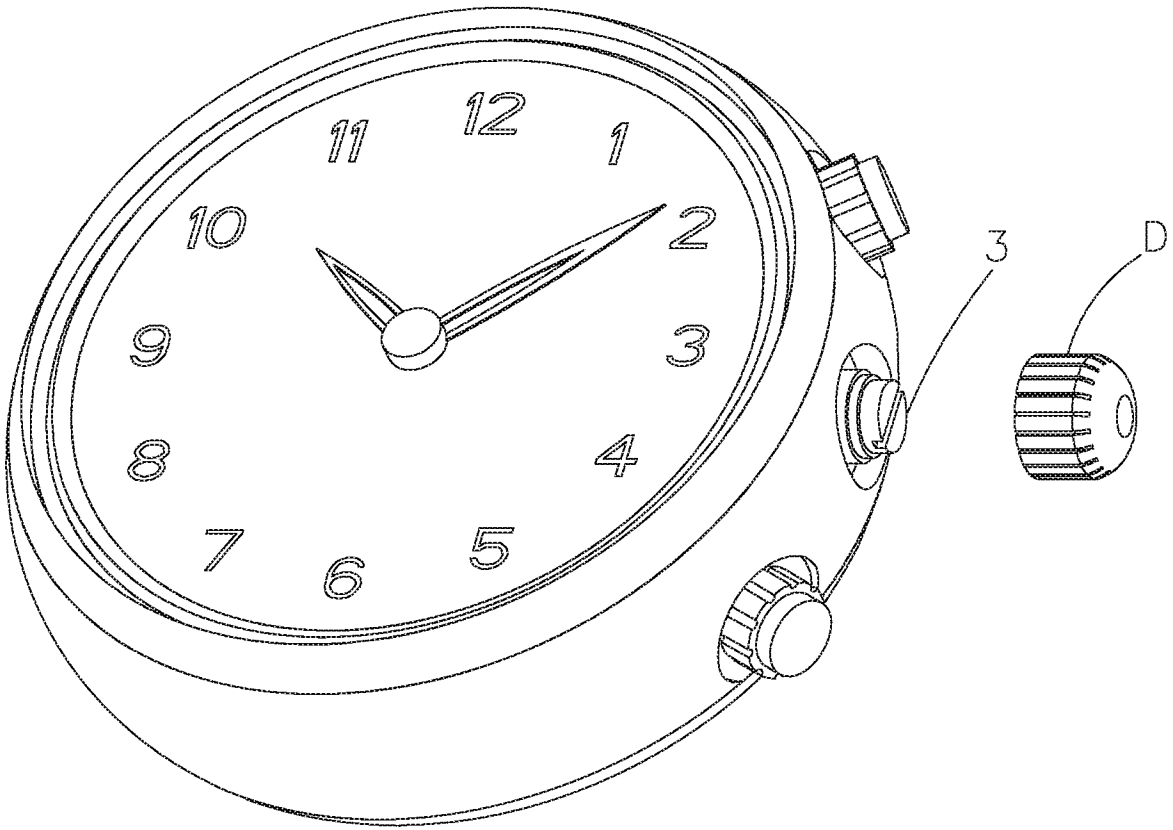
FIG. 25 is a perspective view of the embodiment of this creation (4)
Figure 26:
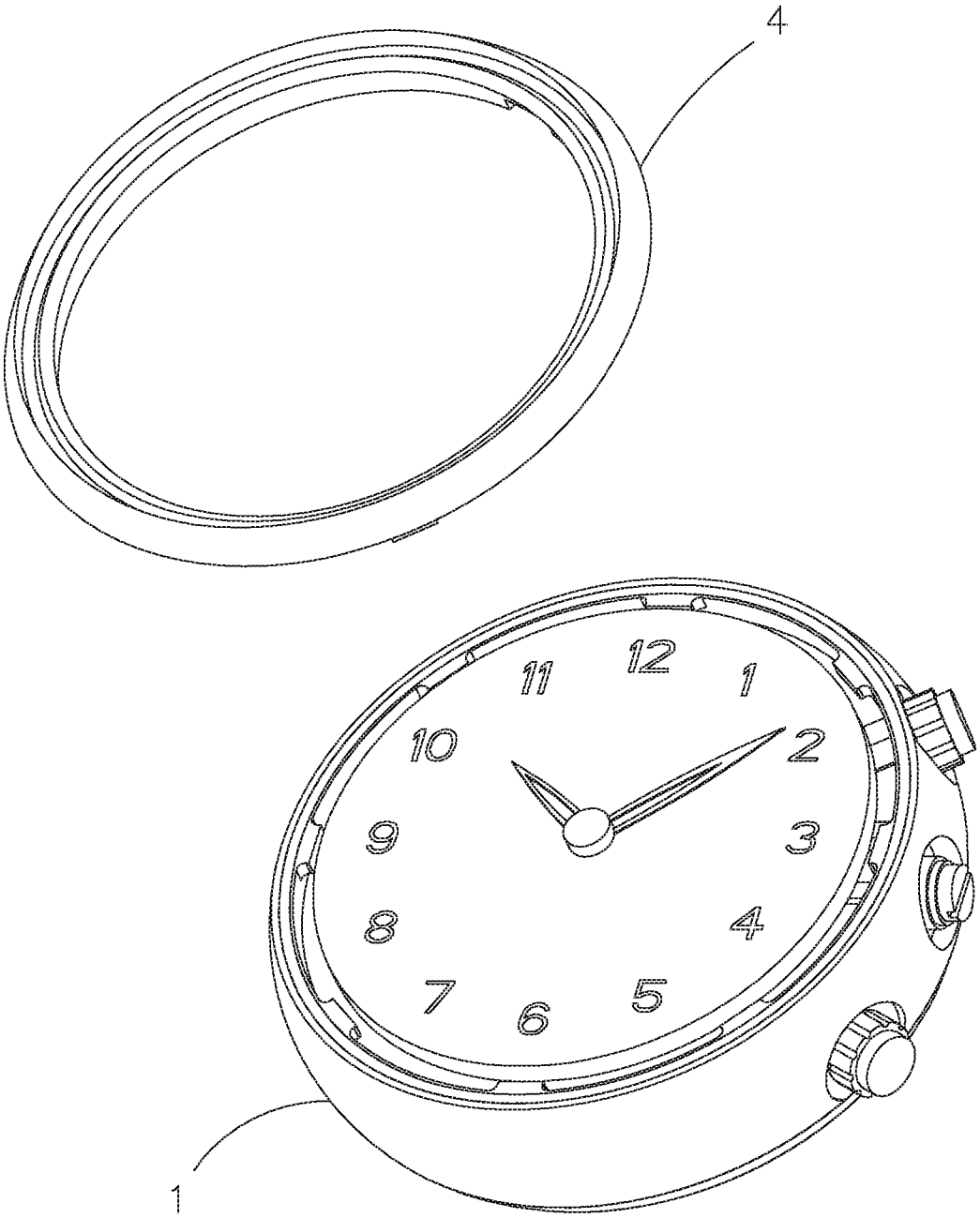
FIG. 26 is a perspective view of the embodiment of this creation (5)
Figure 27:
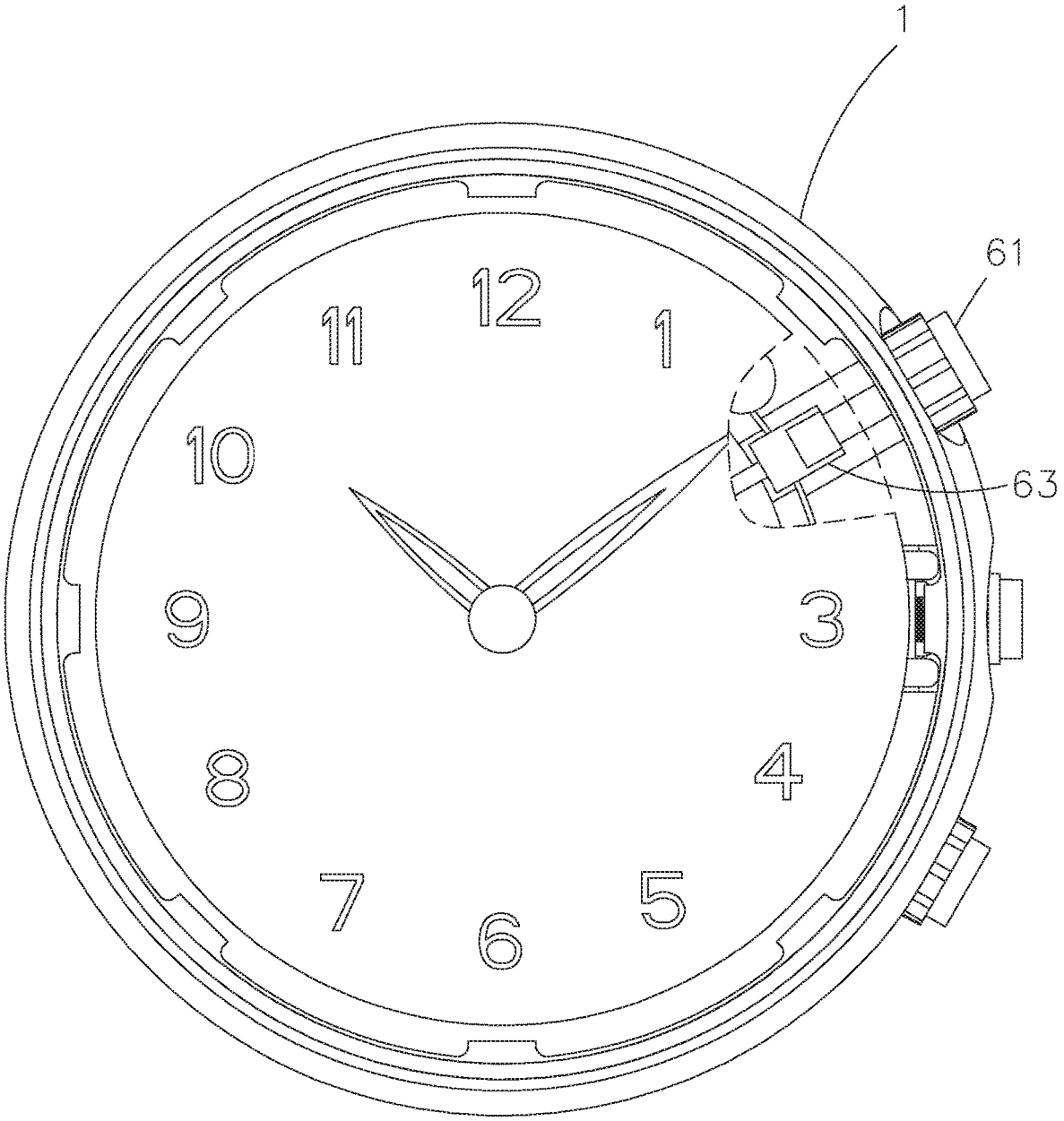
FIG. 27 is a perspective view of the embodiment of this creation (6)
Figure 28:
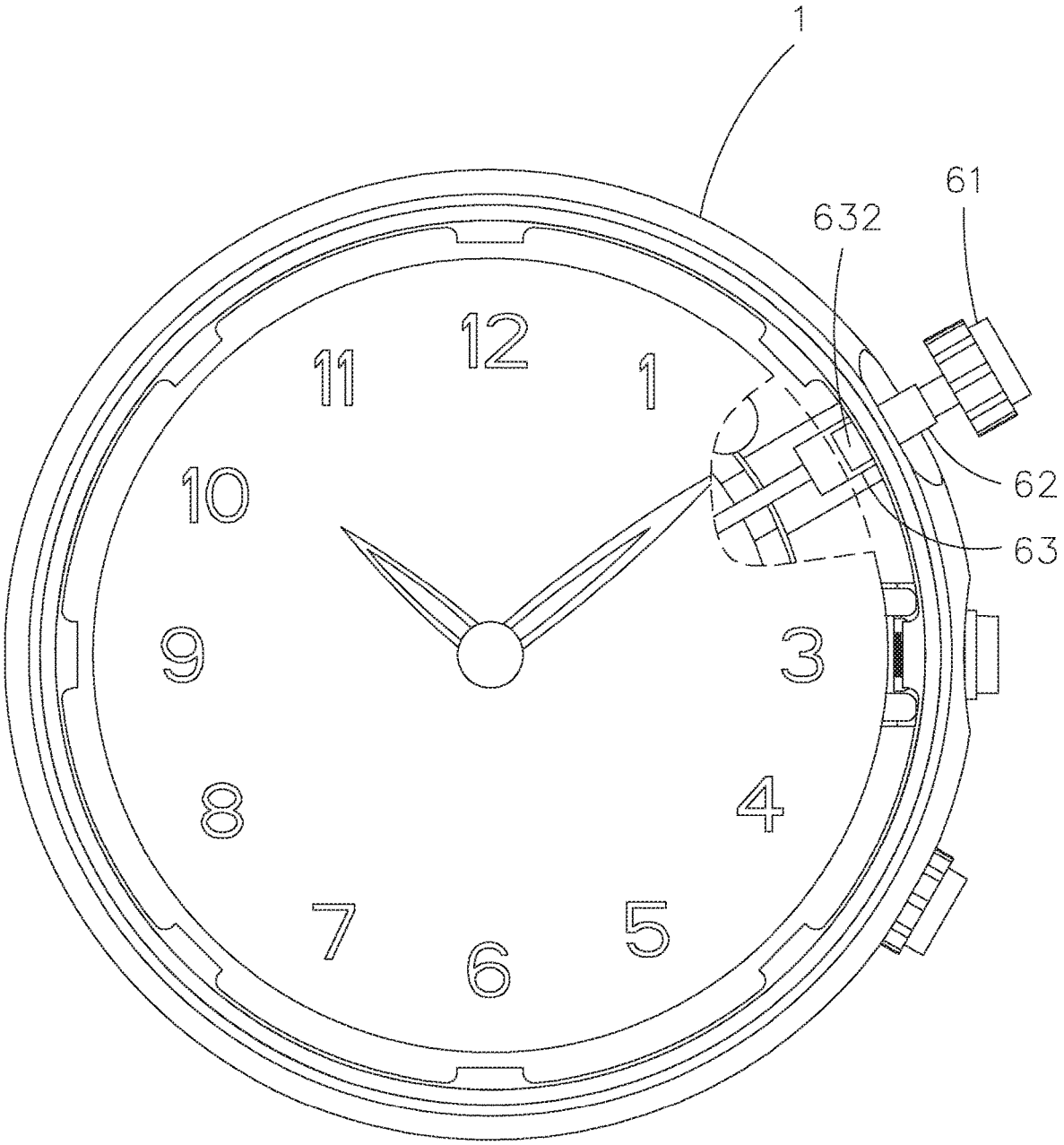
FIG. 28 is a perspective view of the embodiment of this creation (7)
Figure 29:
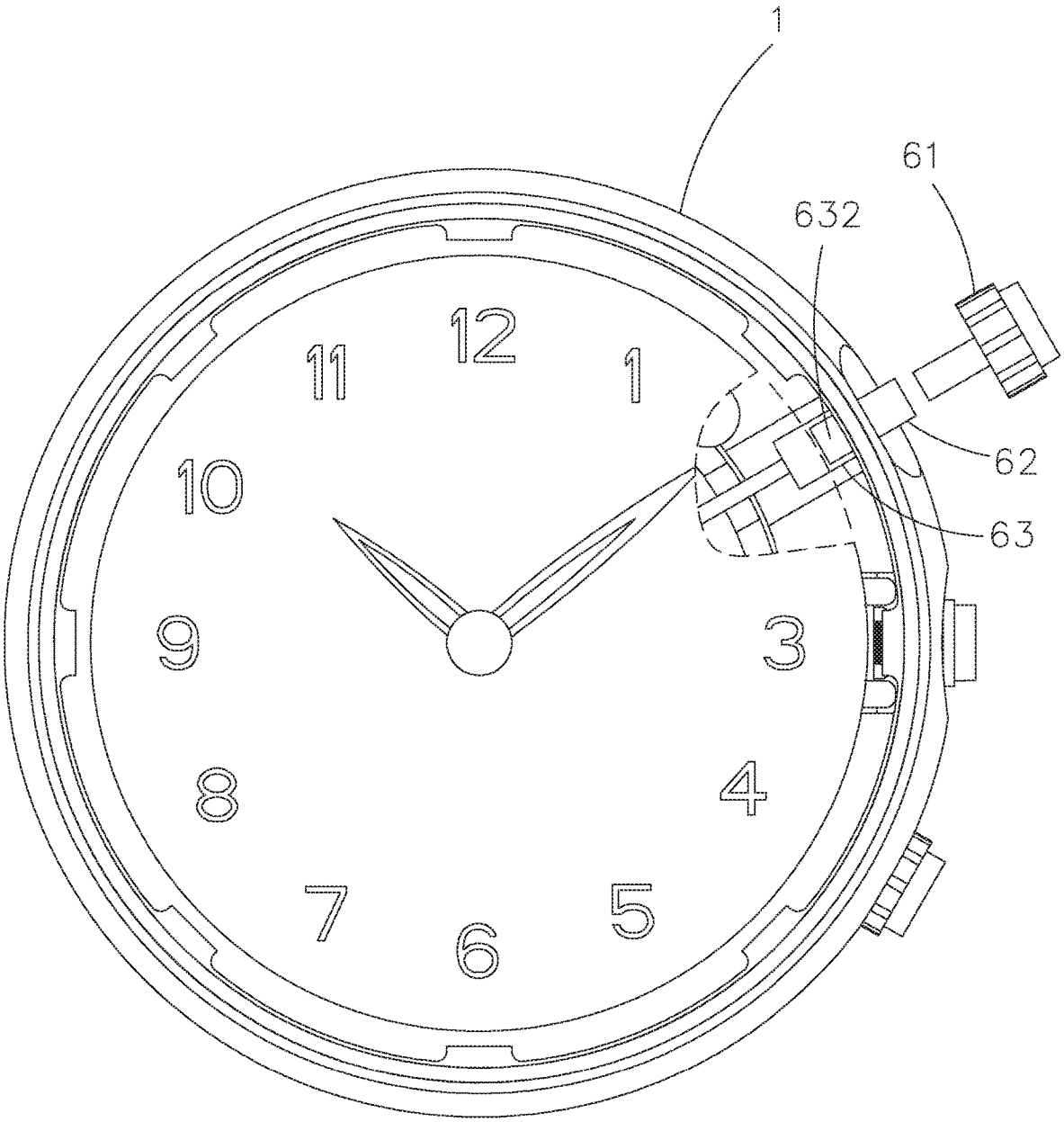
FIG. 29 is a perspective view of the embodiment of this creation (8)
Figure 30:
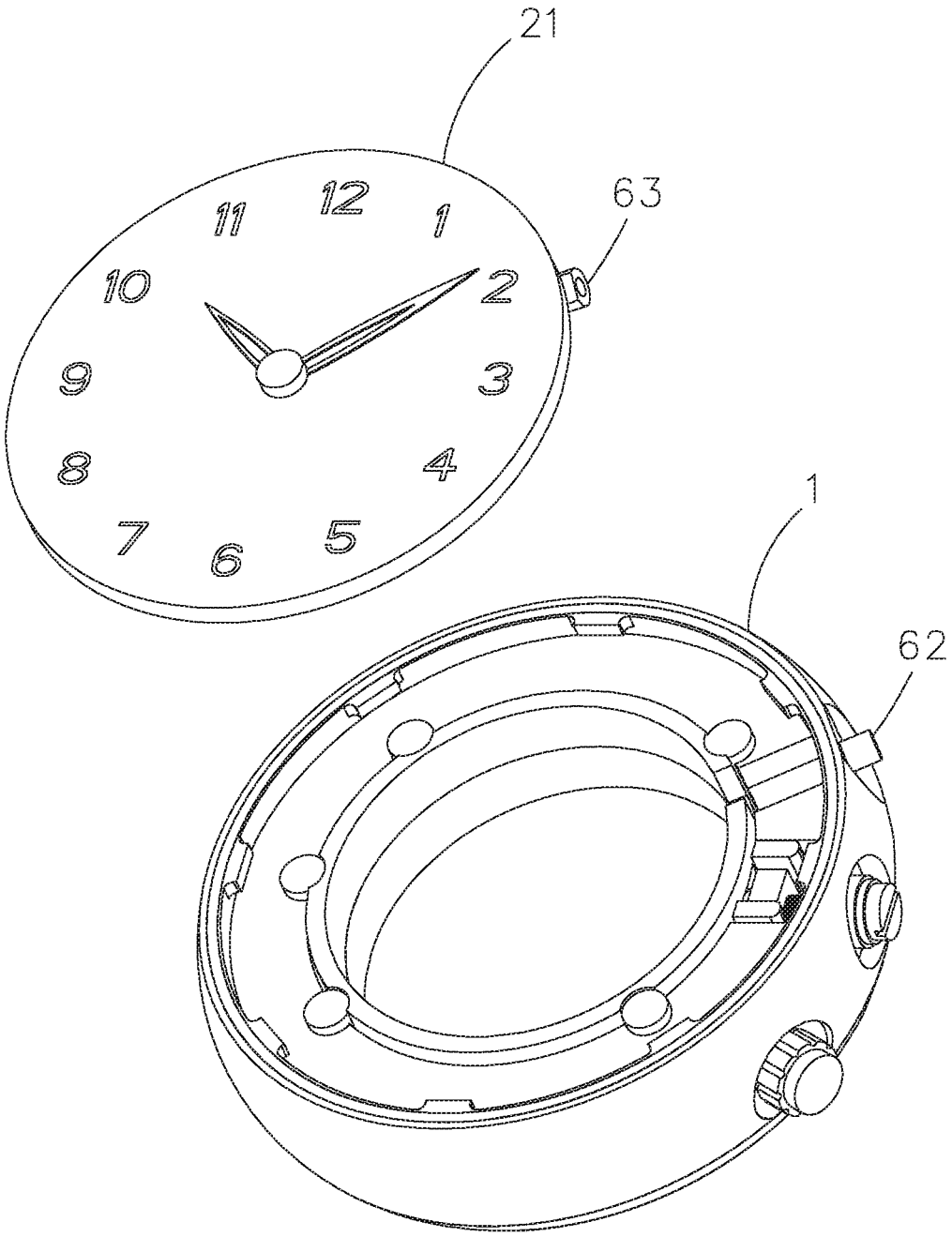
FIG. 30 is a perspective view of the embodiment of this creation (9)
Figure 31:
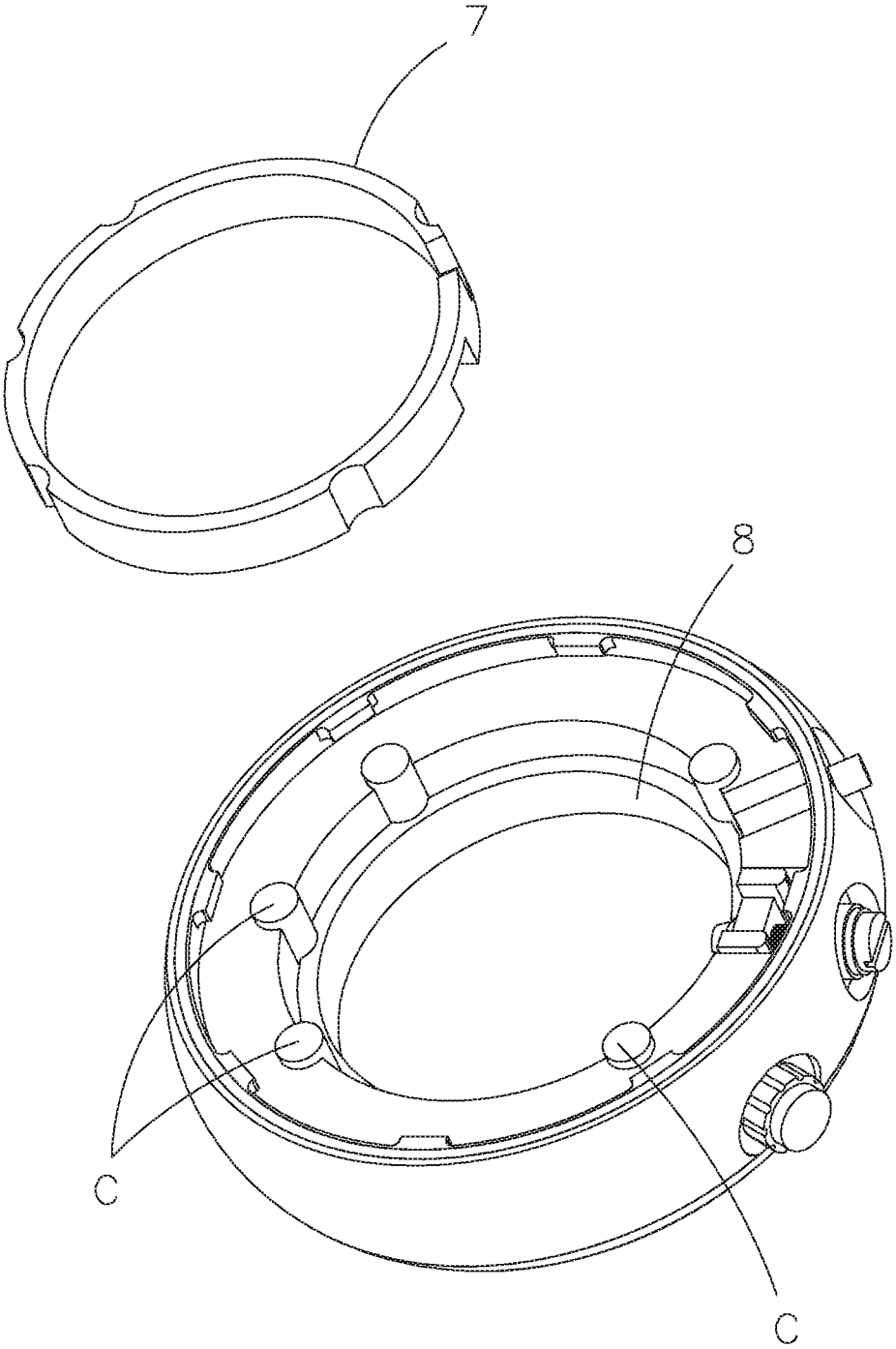
FIG. 31 is a perspective view of the embodiment of this creation (10)

Referring to FIGS. 1 to 16 of the drawings, the invention provides a watch having a double watch-surface and a method for disassembling the double watch-surface. The watch comprises a casing (1). The casing (1) is convexly provided with an abutting ring portion (11); the abutting ring portion (11) has its center being a hollow portion (12). The abutting ring portion (11) is provided with a receiving groove (13); the receiving groove (13) is arranged with a convex portion (14). The two sides of the convex portion (14) form two grooves (15) and a through hole (16) penetrating through the casing (1) and the convex portion (14). Besides, the top and bottom surfaces of the casing (1) are provided with a plurality of pressing protrusions (17) arranged at equal distance, wherein one pressing protrusion (17) is located above the receiving groove (13). An accommodating space (18) is provided between the pressing protrusion (17) and the abutting ring portion (11). A first watch-surface (21) is placed on the top of the abutting ring portion, and the movement components on the first watch-surface are located in the hollow portion (12). A second watch-surface (22) is placed on the bottom of the abutting ring portion, and the movement components on the second watch-surface are located in the hollow portion (12). An adjusting and snapping assembly (3) is composed of an adjusting screw (31), an assembly connector (32), an H-shaped snapping member (33) and an abutting screw (34). The assembly connector (32) is convexly provided with an engaging portion (321) and a threaded through hole (322), and is assembled to the through hole (16) from the outside of the casing (1) through the engaging portion (321). The adjusting screw (31) is provided with an external thread portion (311) and a hollow thread portion (312), and is screwed and assembled with the assembly connector (32) from the outside of the casing (1). The external thread portion (311) of the adjusting screw (31) is protruded from the assembly connector (32). The H-shaped snapping member (33) is provided with a threaded through hole (331) and two raised portions (332) on both sides, forming a recess (333) in the middle of the two raised portions (332). The H-shaped snapping member (33) is screwed to the external threaded portion (311) of the adjusting screw (31). The abutting screw (34) is screwed to the hollow threaded portion (312) of the adjusting screw (31). Through the forward rotation of the adjusting screw (31), the H-shaped snapping member (33) can be moved toward the convex portion (14) of the casing (1), so the two raised portions (332) are attached to the two grooves (15). When the adjusting screw (31) is reversely rotated, the two raised portions (332) are away from the two grooves (15). When the H-shaped snapping member (33) abuts against the abutting screw (34), movement stops. A snapping ring (4) is downwardly provided with a flange (41), which is provided with a plurality of engaging protrusions (42) arranged at equal distance. The flange (41) is provided with a notch (43) on both sides of one of the engaging protrusions (42). The inner ring of the snapping ring (4) is annularly provided with a pressing portion (44) and a groove (45). A transparent cover (5) is engaged with the groove (45). The two snapping rings (4) are respectively engaged with the top surface and the bottom surface of the casing (1). The snapping ring (4) is disposed on the abutting ring portion (11) through the plural engaging protrusions (42). The pressing portion (44) is pressed against the first watch-surface (21) and the second watch-surface (22) to move the engaging protrusions (42) and the two sides' notches of the snapping ring (4) onto the convex portion (14) and the two sides' grooves (15). The adjusting screw (31) is forwardly rotated to make the H-shaped snapping member (33) close to the convex portion (14), so that the two raised portions (332) pass through the two notches (43) of the snapping ring (4) and attach to the two grooves (15). The engaging protrusions (42) are located in the accommodating space (18) between the convex portion (14) and the pressing protrusion (17), and are also engaged in the recess (333) of the H-shaped snapping member (33). Other plural engaging protrusions (42) are all located under the plural pressing protrusions (17). Due to the height of the raised portions (332), the engaging protrusion (42) is unable to move left and right within the recess (333), thereby limiting the space of the engaging protrusion (42) moving left and right and achieving the effect of engaging the snapping rings (4) to the casing (1). When the snapping ring (4) needs to be disassembled, the adjusting screw (31) of the adjusting and snapping assembly (3) is reversely rotated to make the H-shaped snapping member (33) move to the center of the casing (1), making the engaging protrusion (42) no longer restricted by the two raised portions (332), thereby making the snapping ring (4) rotate laterally, so that the plural engaging protrusions (42) are detached from the accommodating space (18) without restriction by the pressing protrusion (17), so the snapping ring (4) can be dismantled from the casing (1). Moreover, the top surface and the bottom surface of the abutting ring portion (11) are provided with grooves (111), which are provided with waterproof washers (E).

Referring to FIGS. 20 to 30, the top surface and the bottom surface of the abutting ring portion (11) are further provided with a first passage portion (112) and a second passage portion (114). The first passage portion (112) and the second passage portion (114) are respectively provided with perforations (113) (115) penetrating the casing. Each of the two perforations (113) (115) is provided with a set of main adjusting assembly (6). The main adjusting assembly (6) is composed of a main screw (61), a hollow assembly connector (62) and a connecting sleeve (63). The hollow assembly connector (62) is provided with an engaging portion (621), through which the hollow assembly connector is fixed to the perforation (113) of the first passage portion (112) from the outside of the casing (1). The main screw (61) is provided with a threaded portion (611). The connecting sleeve (63) is provided with a threaded perforation (631). The main screw (61) penetrates the hollow assembly connector (62) from the outside of the casing (1) and is screwed with the connecting sleeve (63). The other end of the connecting sleeve (63) is screwed with the movement components of the first watch-surface (21) for achieving the effect of adjusting the times for the first watch-surface and for the second watch-surface by each of the main adjusting assemblies (6). Concave portions (46) are provided at positions corresponding to the relative positions of the first passage portion (112) and the second passage portion (114) of the two snapping rings.

In addition, a platform (632) is disposed at the end where the connecting sleeve (63) is assembled with the main screw (61). If one wants to disassemble the first watch-surface (21), after disassembling the snapping ring (4), a gap is left between the first watch-surface (21) and the casing (1). Pulling out the main screw (61) firstly can see the connecting sleeve (63) and the platform (632) at the gap, and using a hand tool to resist against the platform (632) and rotating the main screw (61) can disassemble the main screw (61). At this time, the connecting sleeve (63) is still connected with the movement components of the first watch-surface (21), and there is not any connecting component between the first watch-surface (21) and the casing (1), so the first watch-surface (21) can be lifted up to remove.

Referring to FIGS. 17, 18, 19, 30 and 31, the hollow portion (12) of the abutting ring portion (11) is configured with a first positioning ring (7) and a second positioning ring (8). Further, the abutment ring portion (11) is provided with a plurality of columnar grooves (19). The first positioning ring (7) and the second positioning ring (8) are provided with grooves (71) (81) corresponding to the plural columnar grooves (19), so that the plural columnar grooves (19) and the plural grooves (71, 81) are combined to form a plurality of accommodating holes. The plural accommodating holes are respectively inserted with suspension columns (C) to make this creation have shock prevention and proofing effect. The first positioning ring (7) is provided with an upper notch (72) and a lower notch (73), and the second positioning ring (8) is provided with an upper notch (82) and a lower notch (83). The lower notch (73) of the first positioning ring (7) and the upper notch (82) of the second positioning ring (8) form a window notch, wherein the upper notch (72) of the first positioning ring (7) is left with a moving space for the connecting sleeve (63) and the movement components of the first watch-surface (21), and the lower notch (83) of the second positioning ring (8) is left with a moving space for the connecting sleeve (63) and the movement components of the second watch-surface (22), and the window notch provides the moving space for the adjusting and snapping assembly (3).

As a whole, the invention restricts the movement of the snapping ring (4) on the casing (1) through the adjusting and snapping assembly (3) and changes the past dismantling process and structure of the watch. The hand tools used are simpler and less likely to damage the product itself. Through the design of two watch-surfaces, users can be more flexible to use. No matter the watch-surface style is replaced based on the occasion or traveling to different time zones for another setting, it is simpler and more convenient than the previous single surface watches, thus achieving faster and more convenient effect. It is indeed a practical and durable creation. In addition, a threaded portion (323) is provided on the outside of the assembly connector (32) of the adjusting and snapping assembly (3), and the threaded portion (323) is screwed with a decorative cover (D).

Figure 32:
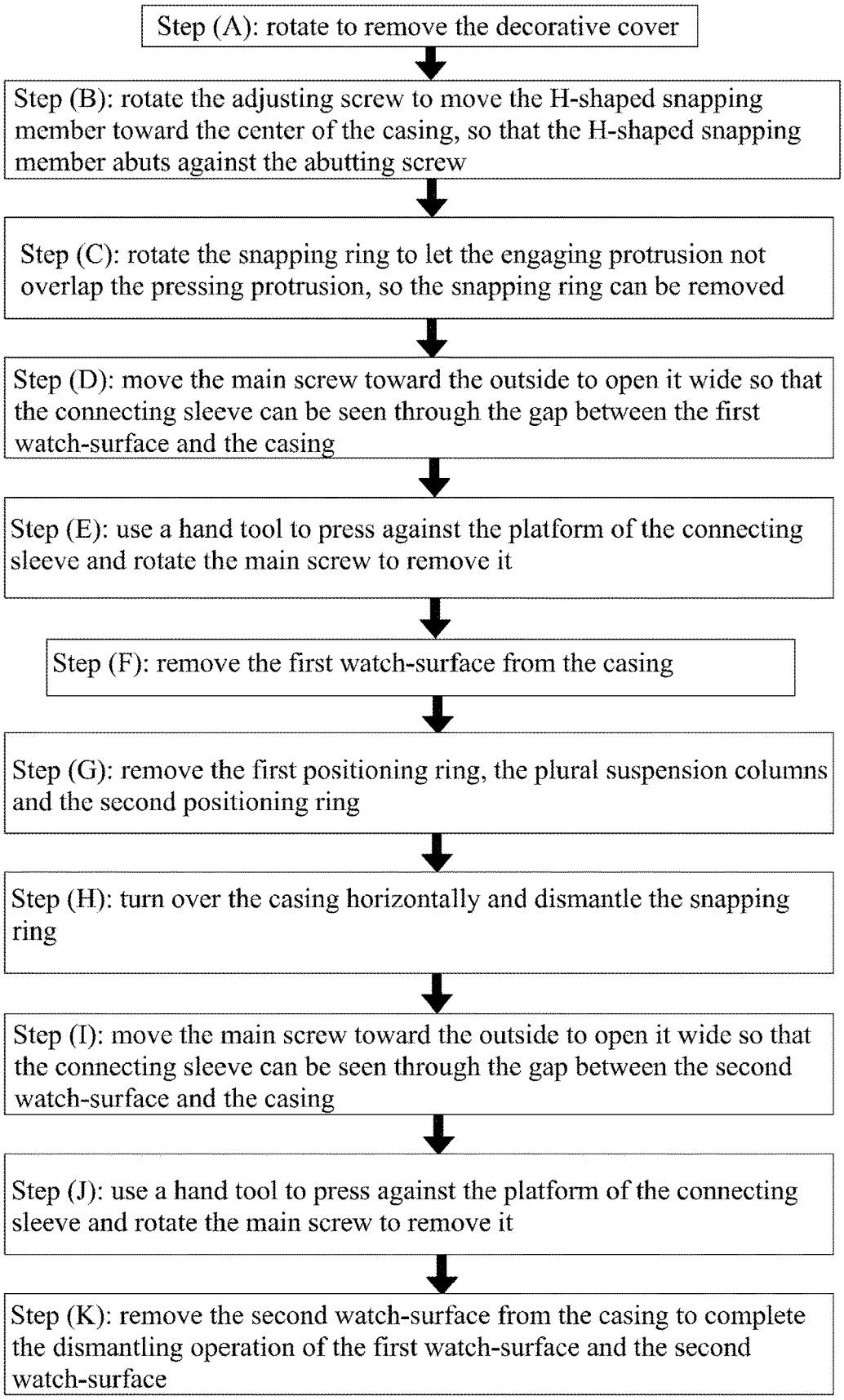
FIG. 32 is a flow chart of a method for disassembling the watch surfaces according to the invention.

Referring to FIG. 32, the steps of the method for disassembling the first watch-surface and the second watch-surface are as follows:

Step (A): rotate to remove the decorative cover (D);

Step (B): rotate the adjusting screw (31) to move the H-shaped snapping member (33) toward the center of the casing (1), so that the H-shaped snapping member abuts against the abutting screw (34);

Step (C): rotate the snapping ring (4) to let the engaging protrusion (42) not overlap the pressing protrusion (17), so the snapping ring (4) can be removed from the casing (1);

Step (D): move the main screw (61) toward the outside to open it wide so that the connecting sleeve (63) can be seen through the gap between the first watch-surface (21) and the casing (1);

Step (E): use a hand tool to press against the platform (632) of the connecting sleeve (63) and rotate the main screw (61) to remove it;

Step (F): remove the first watch-surface (21) from the casing (1);

Step (G): remove the first positioning ring (7), the plural suspension columns (C) and the second positioning ring (8);

Step (H): turn over the casing (1) horizontally and dismantle the snapping ring (4);

Step (I): move the main screw (61) toward the outside to open it wide so that the connecting sleeve (63) can be seen through the gap between the second watch-surface (21) and the casing (1);

Step (J): use a hand tool to press against the platform (632) of the connecting sleeve (63) and rotate the main screw (61) to remove it; and Step (K): remove the second watch-surface (22) from the casing (1) to complete the dismantling operation of the first watch-surface (21) and the second watch-surface (22).

While the invention has been described in terms of preferred embodiments, those skilled in the art will recognize that the invention can be practiced with modifications within the spirit and scope of the appended claims.

What is claimed is:

1. A method for disassembling first and second watch-surfaces of a watch, comprising the steps of:

(A) rotating a decorative cover to remove the decorative cover from the watch;

(B) rotating an adjusting screw to move an H-shaped snapping member toward a center of a casing and the H-shaped snapping member abuts against the adjusting screw;

(C) rotating a snapping ring so that an engaging protrusion does not overlap a pressing protrusion and the snapping ring is configured to be removed from the casing;

(D) opening the watch to see a connecting sleeve through a gap between the first watch-surface and the casing;

(E) using a tool to press against a platform of the connecting sleeve;

(F) rotating the main screw to remove the connecting sleeve;

(G) removing the first watch-surface from the casing;

(H) removing a first positioning ring, a plurality of suspension columns, and a second positioning ring;

(I) turning the casing horizontally to remove the snapping ring;

(J) opening the watch to see the connecting sleeve through a gap between the second watch-surface and the casing;

(K) using the tool to press against the platform of the connecting sleeve;

(L) rotating the main screw to remove the connecting sleeve; and (M) removing the second watch-surface from the casing.

* * * * *